US007827839B2

(12) United States Patent
Tomizawa et al.

(10) Patent No.: US 7,827,839 B2
(45) Date of Patent: Nov. 9, 2010

(54) PROFILE ELEMENT PIPE FOR HYDRAULIC BULGING, HYDRAULIC BULGING DEVICE USING THE ELEMENT PIPE, HYDRAULIC BULGING METHOD USING THE ELEMENT PIPE, AND HYDRAULICALLY BULGED PRODUCT

(75) Inventors: Atsushi Tomizawa, Minoo (JP); Masayasu Kojima, Takarazuka (JP)

(73) Assignees: Sumitomo Metal Industries, Ltd., Osaka (JP); Sumitomo Pipe and Tube Co., Ltd., Ibaraki (JP); Mitsubishi Jidoshakogyo Kabushiki Kaisha, Tokyo (JP)

( * ) Notice: Subject to any disclaimer, the term of this patent is extended or adjusted under 35 U.S.C. 154(b) by 381 days.

(21) Appl. No.: 12/003,389

(22) Filed: Dec. 21, 2007

(65) Prior Publication Data

US 2008/0178650 A1 Jul. 31, 2008

Related U.S. Application Data

(60) Continuation-in-part of application No. 11/806,531, filed on Jun. 1, 2007, now abandoned, which is a division of application No. 11/123,196, filed on May 6, 2005, now abandoned, which is a continuation of application No. PCT/JP2003/014284, filed on Nov. 10, 2003.

(30) Foreign Application Priority Data

Nov. 8, 2002 (JP) ..... 2002-325801

(51) Int. Cl.
*B21D 39/08* (2006.01)

(52) U.S. Cl. ..... 72/58; 72/62; 72/370.06; 72/370.22; 29/421.1

(58) Field of Classification Search ..... 72/58, 72/59, 61, 62, 318, 370.06, 370.22; 29/421.1
See application file for complete search history.

(56) References Cited

U.S. PATENT DOCUMENTS

| | | | |
|---|---|---|---|
| 3,486,703 | A | 12/1969 | Sorlie |
| 3,572,073 | A | 3/1971 | Dean et al. |
| 3,958,437 | A | 5/1976 | Barorian |
| 5,203,190 | A | 4/1993 | Kramer et al. |
| 5,333,775 | A | 8/1994 | Bruggemann et al. |
| 5,419,791 | A | 5/1995 | Folmer |
| 5,445,001 | A | 8/1995 | Snavely |
| 6,216,509 | B1 | 4/2001 | Lotspaih et al. |
| 6,266,986 | B1 | 7/2001 | Morita et al. |
| 6,332,346 | B2 | 12/2001 | Komiya et al. |

(Continued)

FOREIGN PATENT DOCUMENTS

| | | | |
|---|---|---|---|
| EP | 1022073 | A1 | 7/2000 |

(Continued)

*Primary Examiner*—David B Jones
(74) *Attorney, Agent, or Firm*—Clark & Brody

(57) ABSTRACT

According to a bulging device and a bulging method using a profile element pipe, for example, even when a profile steel pipe having a cross sectional shape varying in the axial direction as in a tapered pipe is hydraulically bulged, a bulging in which an internal pressure loading and an axial pressing are combined with each other can be performed to provide a larger expansion ratio than a conventional case and a joining and socket connection thereof to the other part can also be easily performed.

19 Claims, 20 Drawing Sheets

U.S. PATENT DOCUMENTS

| | | | | |
|---|---|---|---|---|
| 6,519,855 | B1 | 2/2003 | Marando | |
| 6,826,943 | B2 * | 12/2004 | Rempe et al. | 72/370.06 |
| 6,941,786 | B1 | 9/2005 | Cooper et al. | |
| 7,013,697 | B2 * | 3/2006 | Barber | 72/370.06 |
| 2002/0162224 | A1 | 11/2002 | Gabbianelli et al. | |

FOREIGN PATENT DOCUMENTS

| | | |
|---|---|---|
| JP | 51-47567 | 4/1976 |
| JP | 52-73168 | 6/1977 |
| JP | 61-037327 | 2/1986 |
| JP | 09-039864 | 2/1997 |
| JP | 2000-045767 | 2/2000 |
| JP | 2000-202535 | 7/2000 |
| JP | 2001-321842 | 11/2001 |
| JP | 2002-035855 | 2/2002 |
| JP | 2002-045924 | 2/2002 |
| JP | 2003-001336 | 1/2003 |
| WO | 00/10748 | 3/2000 |
| WO | 2005/018846 | 3/2005 |

* cited by examiner

PROFILE ELEMENT PIPE FOR HYDRAULIC BULGING, HYDRAULIC BULGING DEVICE USING THE ELEMENT PIPE, HYDRAULIC BULGING METHOD USING THE ELEMENT PIPE, AND HYDRAULICALLY BULGED PRODUCT

This is a continuation in part application of application Ser. No. 11/806,531 filed on Jun. 1, 2007, now abandoned, which is a divisional application Ser. No. 11/123,196 filed on May 6, 2005, now abandoned, which is a continuation of International Patent Application No. PCT/JP2003/014284, filed Nov. 10, 2003.

BACKGROUND OF THE INVENTION

1. Field of the Invention

The present invention relates to a profile element pipe for hydraulic bulging, a hydraulic bulging device using the profile element pipe, a hydraulic bulging method using the profile element pipe, and a hydraulically bulged product subjected to the hydraulic bulging.

2. Description of the Related Art

A hydraulic bulging has more merits as compared with other forming or forming methods. For example, since a profile element pipe can be hydraulically bulged to such an intricate configuration part having different cross-sections in the longitudinal direction of the product, machine parts, which require welding and joining in a conventional method, can be formed in one-piece. Further, since the hydraulic bulging generates work hardening over the entire hydraulically bulged portions, even if a soft element pipe is used, a product having high strength can be obtained.

Further, in the hydraulic bulging, the bulged product has small springback and a dimensional accuracy of the product is excellent (shape fixability is excellent). Thus a process for refining product dimension is not required and the omission of the process is effected.

In the hydraulic bulging, the above-mentioned excellent merits are appreciated and the hydraulic bulging has been particularly adopted as a production method of automotive parts in recent years.

Generally, in case that a pipe is formed by hydraulic bulging, a straight pipe having a uniform circular cross-section in the longitudinal direction of the pipe (hereinafter referred to as "straight element pipe") is used as a material, and after this material was subjected to bending and stamping as a "preforming" hydraulic bulging is performed as a final working process. By taking such a series of working processes, a hydraulically bulged product can be manufactured by processing a straight element pipe to a product of a predetermined configuration.

FIGS. 1A and 1B are views showing a final working process of hydraulic bulging by which a product is obtained by using a conventional straight element pipe. As shown in FIGS. 1A and 1B, in the hydraulic bulging of the final process, a working liquid is injected into a straight element pipe P1 set in an upper die 1 and a lower die 2 through a filling hole 3 to load internal pressure. Further, in addition to the loading of internal pressure, the element pipe P1 is axially pressed (hereinafter referred to as "axial pressing or pushing") from both ends of the pipe by pushing tools 4 and 5 also serving as sealing tools.

In the hydraulic bulging, the loading of internal pressure and the axial pressing are combined with each other so that a product P2 having various cross-sectional shapes is produced. It is noted that the pushing tools 4 and 5 serving also as sealing tools are connected to a hydraulic cylinder (not shown) and during hydraulic bulging its axial position or pressing force are controlled.

The pressing from a pipe end in the axial direction in the hydraulic bulging has such effects that a metal flow during bulging of an element pipe is promoted and an expansion limit of the element pipe is improved. Thus, in the hydraulic bulging, the axial pressing from the pipe end is an extremely important working process.

Specifically, when the hydraulic bulging is performed only by the loading of internal pressure without performing axial pressing or pushing, the wall thickness of the straight element pipe P1 is remarkably decreased with bulging of the straight element pipe P1. Therefore, the straight element pipe P1 ends up in rupture halfway through hydraulic bulging. Namely, it amounts to narrow a formable range (pipe expansion limit) of the straight element pipe P1.

Further, the hydraulic bulging has a problem attributable to a shape of the element pipe. As described above, even if an intricate configuration having different axial cross-sectional shapes can be obtained as one of the merits of the hydraulic bulging, the configuration of a worked product which can be obtained is limited.

For example, when the relationship of the increase ratio in a peripheral length (pipe expansion ratio)=[(outer peripheral length of a worked product at the portion/circumferential length of element pipe)−1] 100% is defined, the limit of increase ratio in a peripheral length (pipe expansion ratio) is at most 25% or so except for a region of the pipe end portion where axial pressing is effective, although the ratio depends on shape properties required for a bulged product or conditions (material, sheet thickness) of an element pipe to be used.

The hydraulic bulging cannot be performed beyond the limit of the increase ratio in the peripheral length (pipe expansion ratio). To increase a degree of freedom in a configuration design of a worked product and to obtain a worked product having a more intricate cross-sectional shape, it is necessary to contrive ways regarding the shape of an element pipe under a restricted condition of such an increase ratio in a peripheral length (pipe expansion ratio).

To deal with this problem, there has been proposed to use a substantially conical element pipe (hereinafter referred to as "tapered element pipe") instead of a straight element pipe. Namely, by using the tapered element pipe, the increase ratio in a peripheral length due to working can be suppressed to a low level for parts which are difficult to be formed by using a straight element pipe, for example, for parts whose peripheral length varies in the axial direction, thereby enabling predetermined working shapes to be formed (see for example, Japanese Patent Application Publication No. 2001-321842, page 1, FIG. 2).

However, when hydraulic bulging is performed by using a tapered element pipe whose cross-sectional shape varies in the axial direction, in case of using a pressing or pushing tool for the straight element pipe shown in FIG. 1, it is found difficult to apply the axial pressing on the tapered element pipe.

FIG. 2 is a view explaining a problem, which arises when axial pressing with a conventional pressing tool for a straight element pipe was applied on a tapered element pipe. As shown in FIG. 2, the shaft pressing itself on a tapered element pipe TP1 cannot be applied on the large diameter side, although the axial pressing itself on the tapered element pipe TP1 can be applied on the small diameter side. However, as a pressing tool 4 advances into forms 1 and 2 with the axial pressing, insufficient restriction of inner and outer surfaces of the tapered element pipe TP1 by the pressing tool 4 side take places, thus likely leading up to seal leakage occurs.

FIGS. 3A to 3C are views explaining hydraulic bulging process using a conventional tapered element pipe, where FIG. 3A shows a state before processing, FIG. 3B shows a state before loading internal pressure, and FIG. 3C shows a state at the finish of processing.

In the conventional hydraulic bulging using the tapered element pipe TP1, as shown in FIGS. 3A to 3C, pressing tools 6 and 7, each having a tapered front end, are to be used. However, since axial pressing cannot be performed, hydraulic bulging is generally completed only by loading internal pressure without axial pressing. It is noted that TP2 in FIGS. 3A to 3C denotes a tapered element pipe subsequent to pipe-end pre-forming and TP3 denotes a hydraulically bulged product.

In the working process shown in FIGS. 3A to 3C, since the axial pressing of the tapered element pipe TP2 cannot be performed, the hydraulic bulging can be performed only in a limited range of forming to such a degree that rupture does not occur in a stage of hydraulic bulging, as described above. Therefore, in the hydraulic bulging, a merit of using the tapered element pipe is not in fact fully utilized.

Thus, in case where hydraulic bulging is performed using a tapered element pipe, a technological development, which enables pressing from the pipe end in the axial direction in addition to loading internal pressure on the element pipe, has been desired.

When hydraulic bulging is performed in a conventional tapered element pipe, there is a problem which arises when a hydraulically bulged product is joined with another member, other than the problem that axial pressing is difficult.

FIGS. 4A to 4C are views explaining a problem when a hydraulically bulged product having a rectangular cross-section is joined, wherein FIG. 4A shows a shape of a conventional hydraulically bulged product, and FIG. 4B shows a shape of a hydraulically bulged product according to the present invention, along with denoting inclinations of pipe end portions with respect to the axial direction of each worked product, and wherein FIG. 4C shows a configuration of a typical cross-section of the hydraulically bulged-products in FIG. 4A or 4B.

The hydraulically bulged product PT3 using a conventional tapered element pipe as a material is inclined in the pipe end portions by θ as shown in FIG. 4A. Thus, since accuracy cannot be ensured in welding and joining with another member, the joining with another member or the like is not easy.

Further, when an end of the pipe is socketed into another part and connected thereto, that is a socket connection, the accuracy cannot be ensured as well. Thus positioning of the tapered element pipe becomes difficult. Consequently, finishing process such as cutting off of very ends of hydraulically bulged product is required.

SUMMARY OF THE INVENTION

The present invention has been made taking the above-mentioned conventional problems into consideration, and the object of the present invention is to provide a profile element pipe for hydraulic bulging, a hydraulic bulging device using the element pipe, a hydraulic bulging method using the element pipe, and hydraulically bulged product, wherein in hydraulic bulging using the profile element pipe having various cross sectional shapes in the axial direction, pressing is enabled from the pipe ends in the axial direction in addition to loading internal pressure on the element pipe, thereby enabling a larger pipe expansion ratio to be achieved.

To attain the above-mentioned object, a profile element pipe for hydraulic bulging according to the present invention is characterized in that the profile element pipe has a varied peripheral length over the axial length with an outer diameter gradually increasing or decreasing from one axial side toward the other thereof and has a parallel part formed on at least one pipe end thereof.

In the profile element pipe for hydraulic bulging of the present invention, a length of the parallel part is preferably not less than the total of an amount of axial pressing performed in the hydraulic bulging and a length necessary for sealing during bulging.

Further, in the profile element pipe to be used for manufacturing a hydraulically bulged product having a rectangular cross section or a polygonal cross section, it is desirable that a radius R of curvature of a corner part in the parallel part is varied in accordance with a change of a peripheral length in which an outer diameter of the profile element pipe is gradually increased or decreased.

And if the profile element pipe of the present invention comprising such a configuration is set into a form of a hydraulic bulging device according to the present invention by respectively providing parallel parts on at least one of end portion inner surfaces of both an upper die and a lower die and on an outer surface of a pressing tool which matches with pipe-end inner surfaces, an internal pressure loading and an axial pressing in combined manner can be applied.

As described above, in the hydraulic bulging, a larger pipe expansion ratio can be obtained than before, and the joining with other parts can be easily performed.

BRIEF DESCRIPTION OF THE DRAWINGS

FIG. 3A shows a state before bulging, FIG. 3B shows a state before loading internal pressure, and FIG. 3C shows a state at the end of bulging.

FIG. 4A shows a shape of a hydraulically bulged product using a conventional tapered element pipe, FIG. 4B shows a shape of a hydraulically bulged product according to the present invention, and FIG. 4C shows a shape of a cross-section of these products.

FIG. 6A shows an example in which parallel parts each having a circular cross section are formed on both ends of the tapered part having circular cross sections and FIG. 6B shows an example in which parallel parts each having a rectangular cross section are formed on both ends of the tapered part having rectangular cross sections.

FIG. 8A is an entire perspective view, FIG. 8B is a developed view and FIG. 8C is a view showing a trapezoidal shape similar to the developed view shown in FIG. 8B.

FIG. 9A is an entire perspective view, FIG. 9B is an enlarged view of the pressing tool on the small diameter side and FIG. 9C is an enlarged view of the pressing tool, which also serves as a small diameter side sealing tool used in the profile element pipe.

FIG. 10A is a cross-sectional view of the pipe at a position away from the pipe end on the small diameter side by $\delta L+L0$, FIG. 10C is a cross-sectional view of the end portion, and FIG. 10B is a cross-sectional view at an arbitrary intermediate position of the pipe.

FIG. 11A is a cross-sectional view at a position away from the pipe end on the large diameter side by $\delta L'+L0'$, FIG. 11C is a cross-sectional view of the end portion of the pipe, and FIG. 11B is a cross-sectional view at the arbitrary intermediate position of the pipe.

FIG. 14A is a cross-sectional view showing of a state of setting a tapered pipe on dies, FIG. 14B is a cross-sectional view showing a state where the parallel part was formed before hydraulic bulging, and FIG. 14C is a cross-sectional view showing a state where hydraulic bulging has been completed.

FIGS. 15A to 15C are views elaborating on FIGS. 14A to 14C in terms of the dimensional parameter.

FIGS. 16A to 16C are views elaborating on FIGS. 14A to 14C in terms of the dimensional parameter.

FIG. 17A is a cross-sectional view showing a state of setting the profile element pipe on the die, FIG. 17B is a cross-sectional view showing a state before hydraulic bulging, and FIG. 17C is a cross-sectional view showing a state after hydraulic bulging.

FIGS. 18A to 18C are the same as in the case of FIGS. 17A to 17C.

FIGS. 19A to 19C are the same as in the case of FIG. 17A to 17C.

DETAILED DESCRIPTION OF THE PREFERRED EMBODIMENTS

Figure 5A:
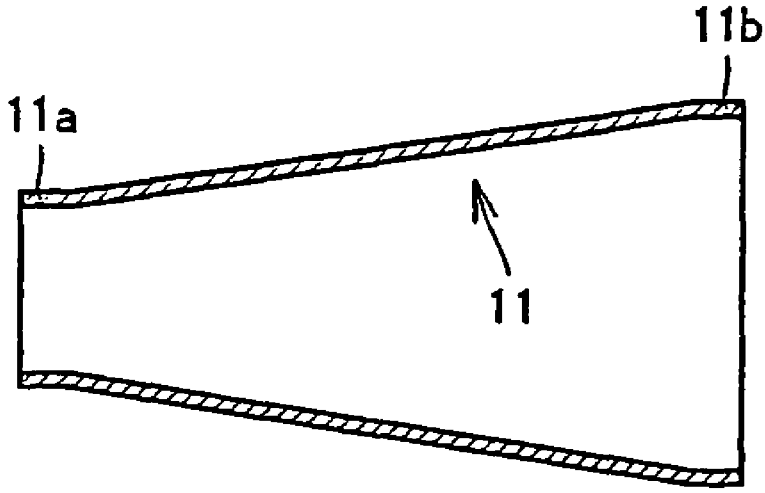
FIGS. 5A and 5B are cross-sectional views showing an example of the shape of a tapered pipe constituting a profile element pipe for hydraulic bulging according to the present invention.
Figure 5B:
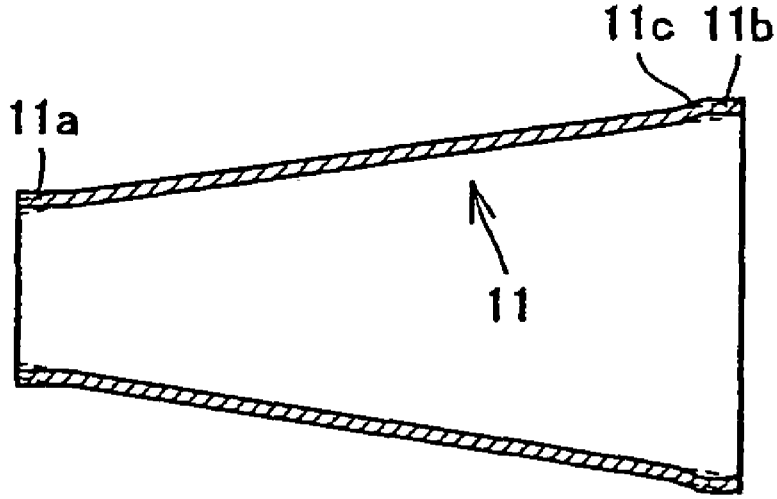

FIGS. 5A to 5B are cross-sectional views showing an example of the shape of tapered pipe constituting a profile element pipe of the present invention. A profile element pipe 11 for hydraulic bulging of the present invention is a profile element pipe to be provided for hydraulic bulging, has a peripheral length with an outer diameter gradually increasing or decreasing over axial length from one axial side toward the other thereof and forms parallel parts 11*a*, 11*b* on at least one pipe-end (both pipe ends of a small diameter side and a large diameter side have parallel parts in the examples shown in FIGS. 5A and 5B). The parts 11*a* and 11*b* are considered to be end portions of the profile element pipe that are parallel to each other since they are each aligned with an axis of the profile element pipe 11. Because the outer diameter of the profile element pipe portion that is between the parallel end parts increases or decreases along its peripheral length, the profile element pipe has a tapered body portion between its ends. In the embodiment of FIGS. 5A and 5B, the tapered body portion is shown between the two parallel parts 11*a* and 11*b*. The parallel parts 11*a* and 11*b* diverge from this taper by reason of being parallel to each other and the longitudinal axis of the profile element pipe 11.

In the profile element pipe for hydraulic bulging according to the present invention, it is desirable that lengths of the parallel parts 11*a*, 11*b* are equal to or more than a total length of an amount of axial pressing in the hydraulic bulging and a length necessary for sealing. As explained in the background art section, axial pressing or pushing involves applying an axially pressing force on the ends of the profile element pipe using pressing tools. The pressing tools also function to seal the ends of the profile element pipe so that the profile element pipe can be internal pressurized for hydraulic bulging. In the embodiment when there are parallel parts at each end of the profile element pipe, the parallel parts 11*a* and 11*b* engage the pressing tools in a first length to form a seal. When the pushing tools are used for axially pressing of the profile element pipe, the tools move a second length during the pressing step that causes metal flow. The length of the parallel part on the profile element pipe, whether formed prior to engagement or as part of the engagement with the pressing tool as explained below, can be such that it exceeds the length of the parallel part that is in contact with the pressing tool when the pressing tool is engaged the parallel part for sealing and the distance the pressing tool moves during the axially pressing step. The control of the length of the parallel part in this manner ensures that the sealing function is not compromised.

Figure 6A:
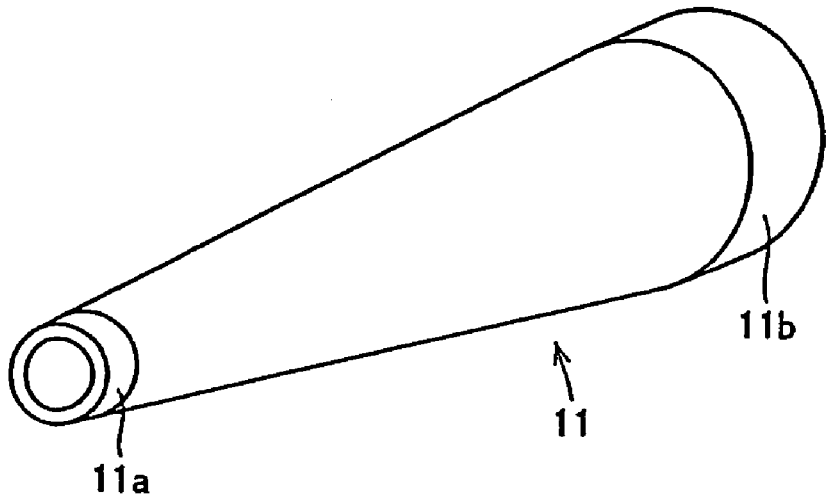
FIGS. 6A and 6B are views illustrating the entire configuration of the profile element pipes according to the present invention, and particularly
Figure 6B:
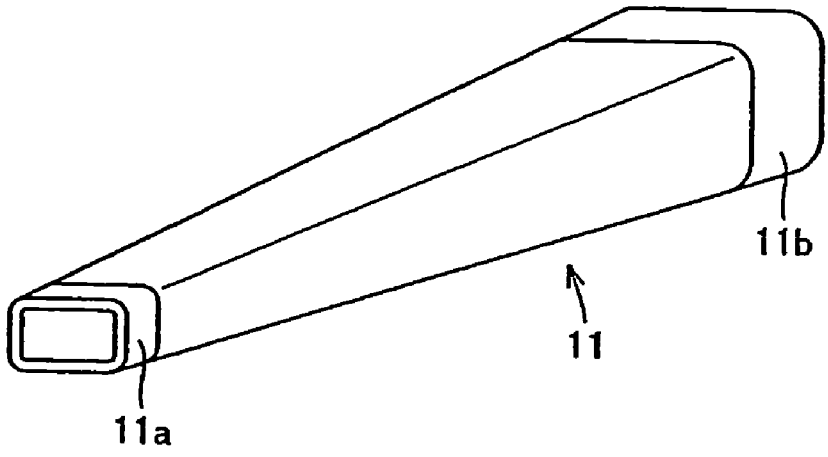

FIGS. 6A and 6B are views illustrating the entire configuration of profile element pipe according to the present invention, where FIG. 6A shows an example in which parallel parts each having a circular cross section are formed on both ends of tapered part having circular cross sections and FIG. 6B shows an example in which parallel parts having a rectangular cross section are formed on both ends of the tapered part having rectangular cross sections.

Here, the example shown in FIG. 5A is elaborated by using FIGS. 6A and 6B. FIG. 6A shows the rudimental basic form, in which parallel parts 11*a* and 11*b* each having a circular cross-section are formed on both ends of tapered part having circular cross-sections.

FIG. 6B is an example in which parallel parts 11*a* and 11*b* each having a rectangular cross-section are formed on both ends of tapered part having rectangular cross-sections. In the example shown in FIG. 6B, the parallel parts 11*a* and 11*b* have a cross-section shown in FIG. 10A to be described later on a small diameter side 11*a* and have a cross-section shown in FIG. 11C to be described later on a large diameter side 11*b* over the entire length.

Figure 7A:
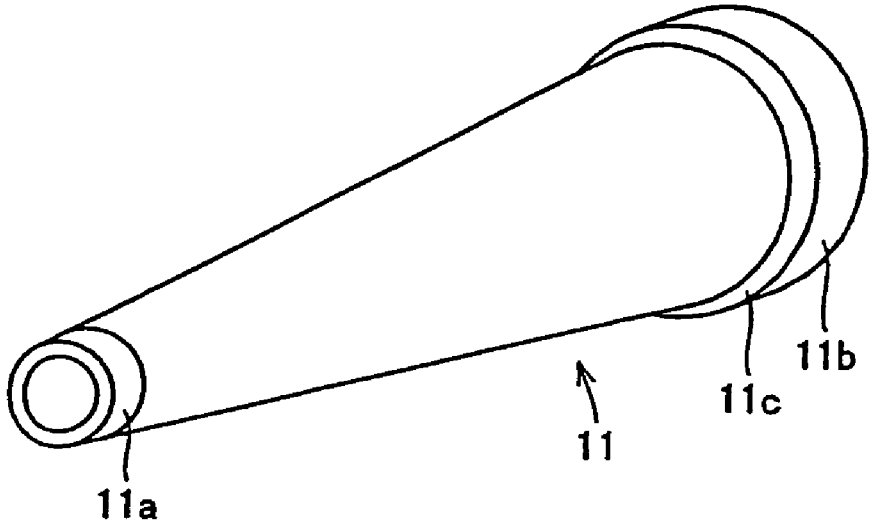
FIGS. 7A and 7B are views illustrating the entire configuration of other profile element pipes according to the present invention, and show examples having a transitional part between a parallel part on the large diameter side and a central tapered part.
Figure 7B:
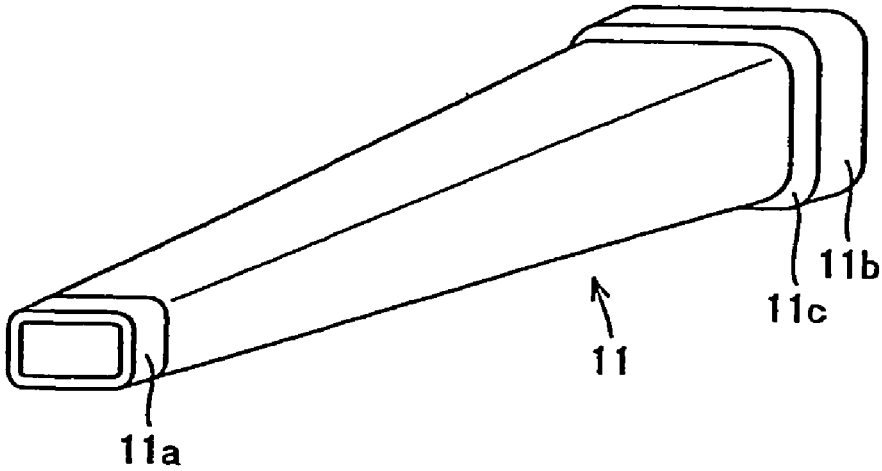

FIGS. 7A and 7B are views illustrating the entire configurations of other profile element pipes according to the present invention, and show examples having a transitional portion between a parallel part on the large diameter side and a central tapered part.

Next, the details of the example shown in FIG. 5B will be described by using FIGS. 7A and 7B. FIG. 7A shows a view in which parallel parts 11*a* and 11*b* each having a circular cross section are formed on both ends of a tapered part having a circular cross section and a transition portion 11*c* is provided between the large diameter side parallel part 11*b* and the central tapered part.

FIG. 7B shows a view in which parallel parts 11*a* and 11*b* each having a rectangular cross section are provided on both ends of a tapered part having a rectangular cross section and a transition portion 11*c* is also provided between the large diameter side parallel part 11*b* and the central tapered part.

Figure 12A:
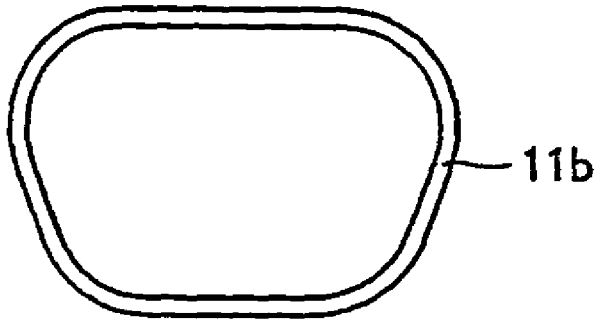
FIGS. 12A to 12C are views illustrating cross-sectional shapes in case that hydraulically bulged products have trapezoidal cross-sections.
Figure 12B:
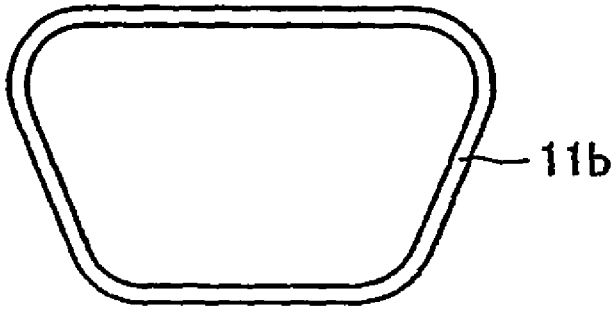
Figure 12C:
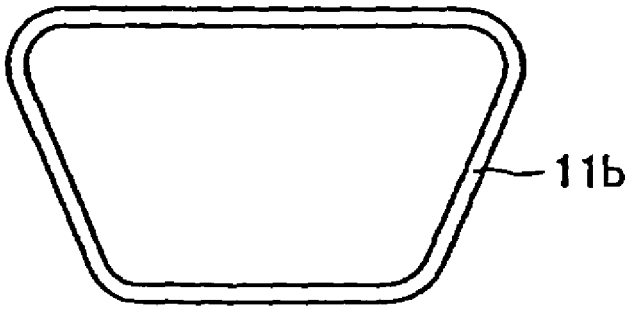
Figure 13A:
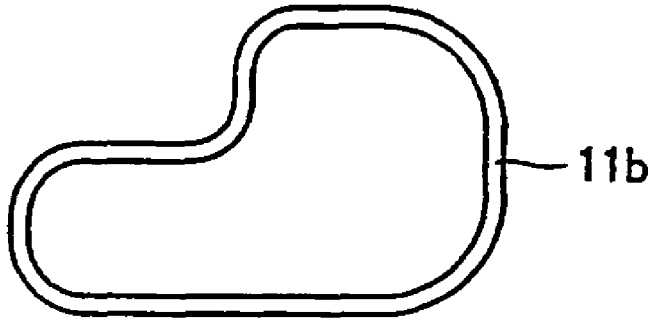
FIGS. 13A to 13C are views illustrating cross-sectional shapes in case that hydraulically bulged products have L-shaped cross-sections.
Figure 13B:
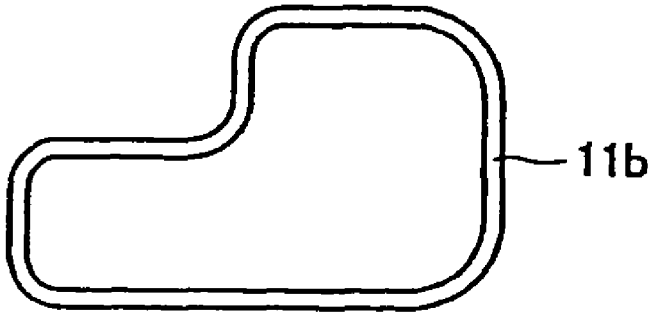
Figure 13C:
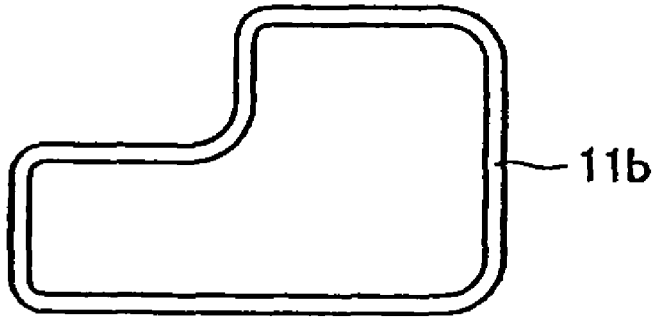

In FIGS. 6B and 7B, although the parallel parts 11*a* and 11*b* formed on the both ends, each of whose shapes is merely a rectangular cross section, are shown, the shapes of the parallel parts 11*a* and 11*b* can be a trapezoidal cross section as shown in FIGS. 12A to 12C to be described later, an L-shaped cross-section as shown in FIGS. 13A to 13C to be described later, a polygonal cross section not shown or the like.

In this case, if the final shape of a hydraulically bulged end surface is designed so that it agrees with a shape of an end surface of a product, the yield loss of material may be reduced, which is appreciated very much.

Further, in FIGS. 6B and 7B, although the central tapered part also having rectangular cross sections is shown, the central part is not particularly required to have rectangular cross sections and they may be a circular cross section as shown in FIGS. 6A and 7A. Alternatively, the central part may be subjected to bending or to pressing from upper and lower sides as well as from right and left sides so that a profile element pipe can be facilitated to be inserted into a hydraulic bulging die.

Figure 8A:
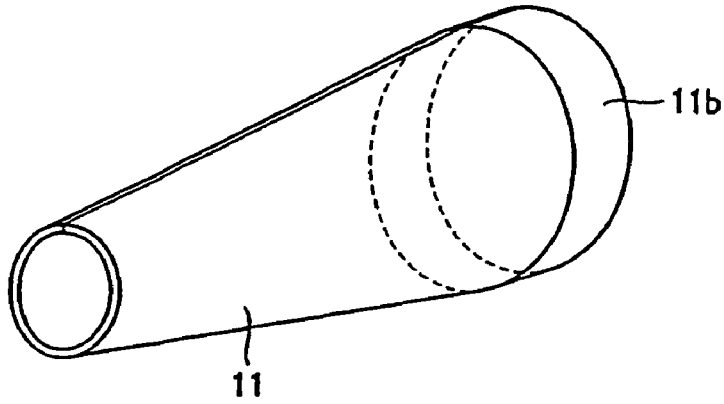
FIGS. 8A to 8C are views explaining a method of producing the profile element pipe according to the present invention, having a parallel part on the end portion of a large diameter side desired, where
Figure 8B:
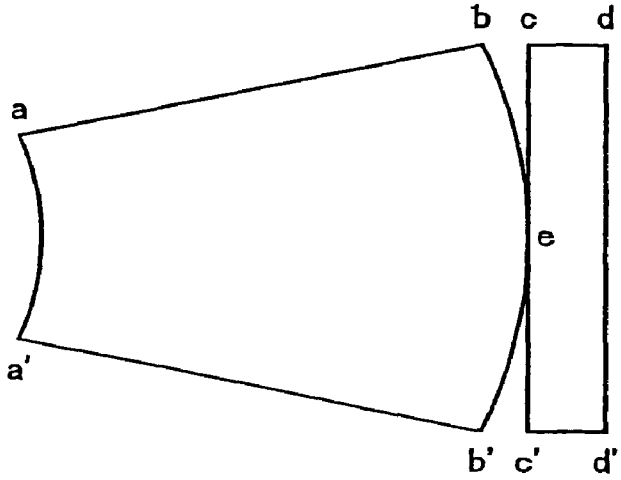
Figure 8C:
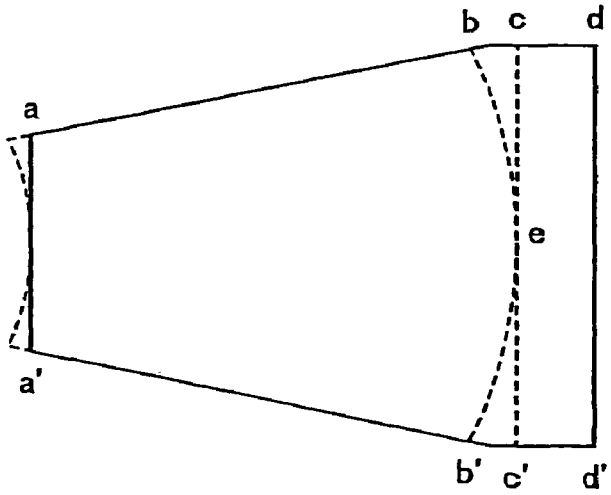

FIGS. 8A to 8C are views explaining a method of producing the profile element pipe according to the present invention having a parallel part on end portion of a large diameter side, and particularly FIG. 8A is an entire perspective view, FIG. 8B is a developed view and FIG. 8C is a view showing a trapezoidal shape similar to the developed view shown in FIG. 8B.

A method of producing a profile element pipe 11 according to the present invention having a parallel part 11*b* on a large diameter side end portion of a tapered part having a circular cross-section as shown in FIG. 8A will be described as follows.

If a sheet having a shape shown in FIG. 8B is subjected to a simple bending and edges of a-b and a'-b', edges of c-d and c'-d', edges of b-e and c-e, and edges of b'-e and c'-e, are joined respectively, a profile element pipe 11 having a parallel part 11*b* on the large diameter side end portion can be obtained as shown in FIG. 8A.

Meanwhile, in FIG. 8C, FIG. 8B is shown in addition by broken lines and a trapezoidal shape which is close to this is shown by solid lines.

As apparent from the comparison between the solid lines and broken lines, when the trapezoid shown by solid lines in FIG. 8C is simply bent, a region b-c-e and a region b'-c'-e' constitute a surplus. Namely, in a sheet bending process using a material of a trapezoidal shape, it is difficult to produce a profile element pipe having a parallel part 11*b* at an end portion such as the profile element pipe 1 according to the present invention.

Although the most simple method for producing the profile element pipe is a method comprising the process of simply bending a plate having a developed shape of a profile element pipe 11 according to the present invention to join with ends, other methods of producing profile element pipes 11 according to the present invention having shapes shown in FIGS. 6A and 6B and FIGS. 7A and 7B besides the above-mentioned method will be described.

In case of the shape shown in FIG. 6A, the profile element pipe 11 according to the present invention can be obtained by expanding an inner diameter on the small diameter side and by reducing an outer diameter on the large diameter side using "a merely tapered pipe" as a material, for example. Further, in case of the shape shown in FIG. 6B, it can be obtained by stamping the central body part in addition to the above-mentioned pre-forming.

In the description of the present invention, the term "a merely tapered pipe" means a material of a profile element pipe of the present invention and a tapered pipe in which a parallel part has not yet been formed on one pipe end or both pipe ends.

In case of the shape shown in FIG. 7A, the profile element pipe 11 according to the present invention can be obtained by expanding inner diameters on the small diameter side and the large diameter side using "a merely tapered pipe" as a material, for example. Further, in case of the shape shown in FIG. 7B, it can be obtained by stamping the central body part in addition to the above-mentioned working process.

Figure 9A:
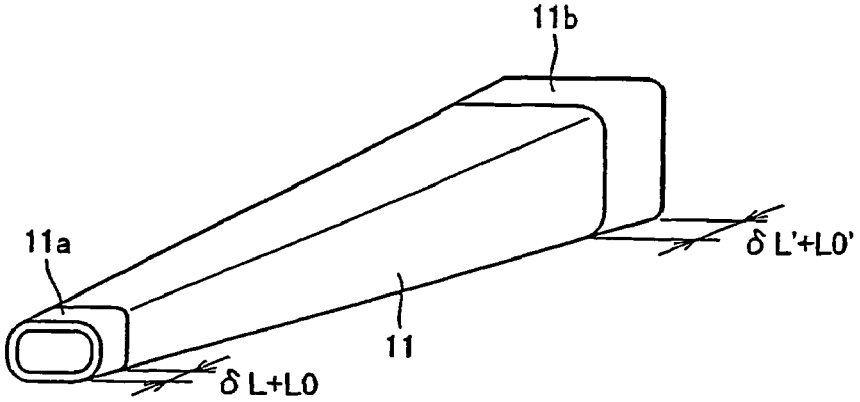
FIGS. 9A to 9C are views showing another example of the profile element pipe according to the present invention along with a pressing tool used in the example, where
Figure 9B:
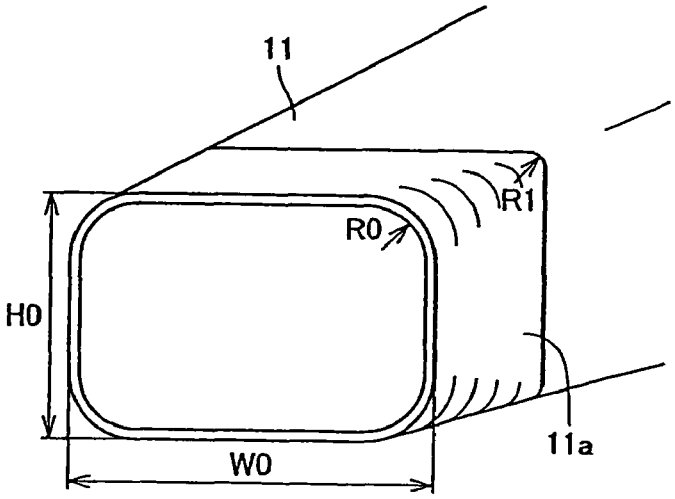
Figure 9C:
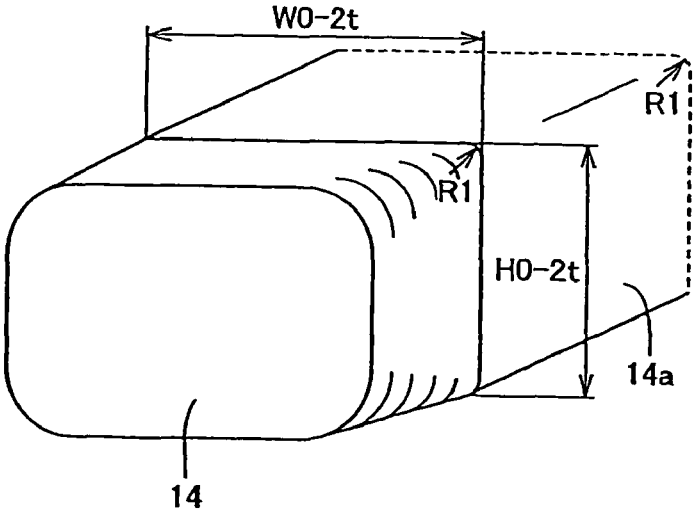

FIGS. 9A to 9C are views showing another example of the profile element pipe according to the present invention and axial pressing or pushing tool used in the example, where FIG. 9A is an entire perspective view, FIG. 9B is an enlarged view of the profile element pipe on the small diameter side and FIG. 9C is an enlarged view of the pushing tool, which also serves as a small diameter side sealing tool used in the pushing tool. In the example shown in FIGS. 9A to 9C, an embodiment shown in FIG. 9A forms parallel parts 11*a* and 11*b* each having rectangular cross section at both ends of a tapered part having rectangular cross sections.

Further, in the example shown in FIGS. 9A to 9C, rectangular cross sections having dimensions of substantially the same width and height as those of the product are formed on a portion corresponding to Δl+L0 in the small diameter side parallel part 11*a* and on a portion corresponding to Δl'+L0' in the large diameter side parallel part 11*b* in the merely tapered pipe.

Further, by determining a radius R of curvature of a corner part as described later, extremely smooth pressing of a material can be performed with dies 12 and 13 and pressing tools 14 and 15 also serving as sealing tools in the hydraulic bulging, without generating bucking or the like due to axial pressing during hydraulic bulging.

Figure 10A:
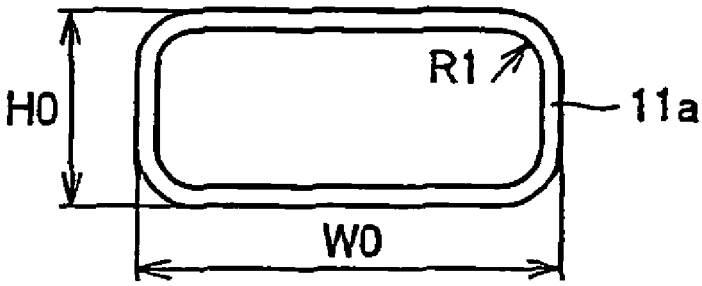
FIGS. 10A to 10C are views showing shapes of end surfaces of the profile element pipe of the present invention used in case where a small diameter side of a hydraulically bulged product has a rectangular cross section, where
Figure 10B:
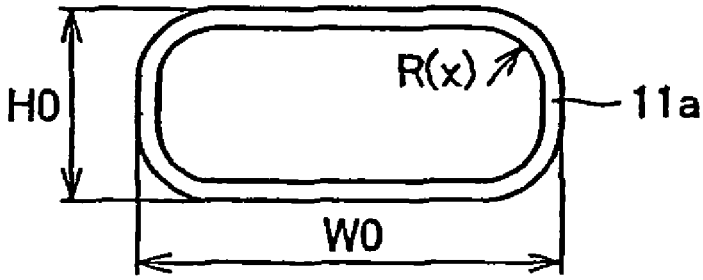
Figure 10C:
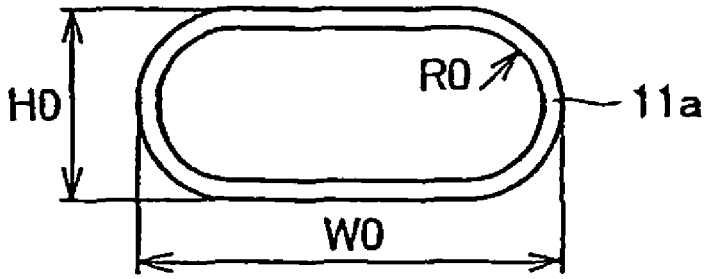

FIGS. 10A to 10C are views showing shapes of end surfaces of the profile element pipe of the present invention used in case that a small diameter side of a hydraulically bulged product has a rectangular cross section, where FIG. 10A shows a cross-sectional view at a position away from the pipe end on the small diameter side by Δl+L0, FIG. 10C shows a cross-sectional view of the end portion of the pipe, and FIG. 10B is a cross-sectional view at an arbitrary intermediate position of the pipe. The profile element pipe of FIG. 10A shows a polygonal cross section, i.e., a rectangular cross section, with a radius of curvature R formed where the sides of the polygon meet. FIGS. 10A-10C show how the radius of curvature of the corner part decreases as measured along the length of the parallel part when starting at the end of the pipe, denoted by FIG. 10C, and terminating at the position away from the end of the pipe, denoted by FIG. 10A. Depending on how the radius of curvature is made to vary, it could either increase or decrease along the parallel part length when starting from the end of the parallel part.

Namely, FIGS. 10A to 10C are views explaining a shape in each of cross sections of the small diameter side parallel part 11*a* of a profile element pipe of the present invention, and widths W0 and heights H0 in cross sections of FIGS. 10A to 10C are substantially constant. Further, the radius R of curvatures of corner part is gradually changed by previous forming.

As shown in FIGS. 10A to 10C, if a radius of curvature of corner part in the small diameter side end portion is R0, a radius of curvature of corner part at a position away from the small diameter side pipe end by Δl+L0 in the axial direction is R1, and a radius of curvature of corner part at a position away from the small diameter side pipe end by X in the axial direction is R(x), these radiuses have relationships of the following expression (1).

$$R0 \geqq R(x) \geqq R1 \quad (1)$$

In the examples shown in FIGS. 10A to 10C, the radiuses of curvatures of four corner parts in each cross section were set as the same. However, it is not necessary that they are set to be the same, and different radiuses of curvatures at every corner part may be used.

More specifically, a peripheral length difference δd(x) at the position X away from a pipe end while setting a distance between both pipe-ends of a merely tapered pipe as a reference length, is obtained from the following expression (2). In this case, D0 denotes an outer diameter on the small diameter side, D0' denotes an outer diameter on the large diameter side and LT denotes a length of the tapered pipe.

$$\Delta d(x) = \pi \cdot (D0' - D0) \cdot X/LT \quad (2)$$

When a cross section of the end portion is pre-formed to a rectangular cross section having a width of W0 and a height of H0, the dimension of a radius R(x) of curvature of the corner part is varied at axial positions in accordance with the peripheral length difference δd(x) as shown in FIGS. 10A to 10C, so that a suitable shape of the pipe in pre-forming can be determined.

Figure 11A:
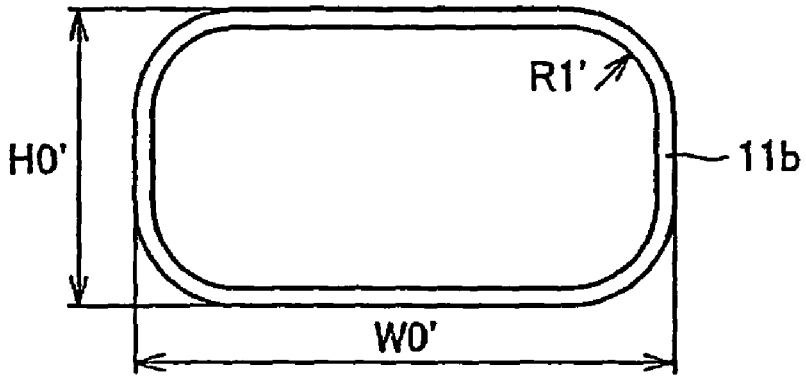
FIGS. 11A to 11C are views showing shapes of end surfaces of the profile element pipe of the present invention used in case where a large diameter side of a hydraulically bulged product has a rectangular cross section, and particularly
Figure 11B:
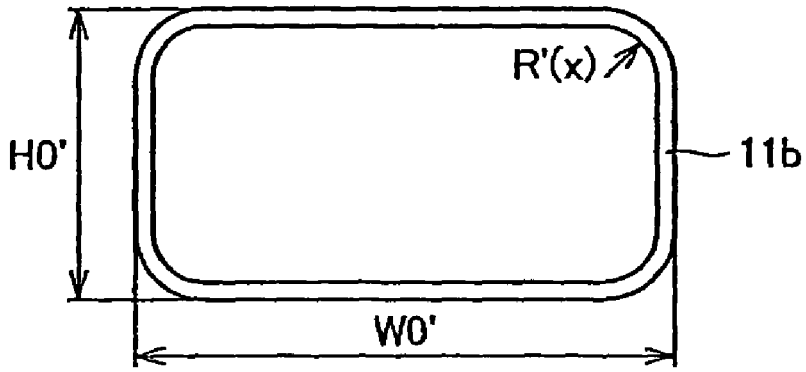
Figure 11C:
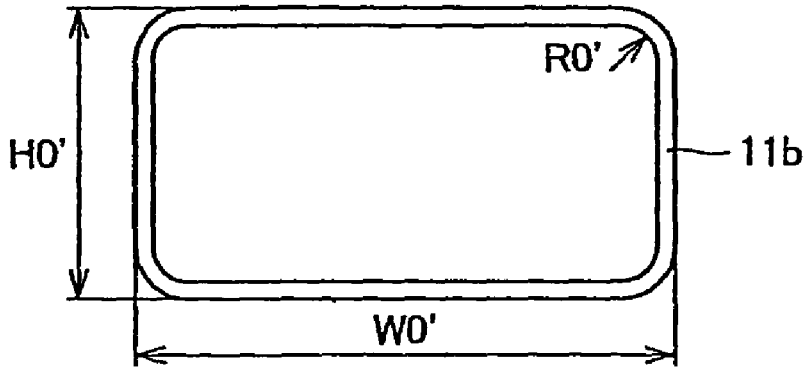

FIGS. 11A to 11C are views showing shapes of end surfaces of the profile element pipe of the present invention used in case that a large diameter side of a hydraulically bulged product has a rectangular cross section, where FIG. 11A is a cross-sectional view of a pipe at the position away from the pipe end on the large diameter side by Δl'+L0', FIG. 11C is a cross-sectional view of the end portion of the pipe, and FIG. 11B is a cross-sectional view at the intermediate position of the pipe.

Namely, FIGS. 11A to 11C are views explaining a shape in each cross section of the large diameter side parallel part 11*b* of the profile element pipe of the present invention, and widths W0' and heights H0' in cross sections in FIGS. 11A to 11C are substantially constant. Further, the radius R' of curvatures of corner part is gradually changed by pre-forming.

As shown in FIGS. 10A to 11C, if the radius of curvature of corner part in the large diameter side end portion is R0', the radius of curvature of corner part at a position away from the large diameter side end portion by Δl'+L0' in the axial direction is set to R1', and the radius of curvature of corner part at a position away from the large diameter side end portion by X in the axial direction is R'(x), these radiuses have relationships of the following expression (1').

$$R0' \geqq R'(x) \geqq R1' \quad (1')$$

Specifically, the peripheral length difference δd(x) at a position X away from the edge of pipe end while setting a distance between both pipe ends of a merely tapered pipe as a reference length, is obtained from the following expression (2'). In this case, D0 denotes an outer diameter on the small diameter side, D0' denotes an outer diameter on the large diameter side and LT denotes a length of the tapered pipe.

$$\Delta d(x) = \pi \cdot (D0' - D0) \cdot X/LT \quad (2')$$

When the cross section of the end portion is previously formed to the rectangular cross section having a width of W0' and a height of H0', the dimension of the radius R'(x) of curvature of corner part is varied at axial positions in accordance with the peripheral length difference δd(x) as shown in FIGS. 11A to 11C, so that the suitable shape of the pipe can be determined.

Although the case that a hydraulically bulged product has a rectangular cross section has been described as above, the profile element pipe of the present invention are not limited thereto. Alternatively, a combined rectangular shape or a polygonal shape can be adopted and extremely stable axial pressing can be performed during hydraulic bulging.

FIGS. 12A to 12C are views illustrating cross-sectional shapes in case that hydraulically bulged products have trapezoidal cross-sections. FIGS. 13A to 13C are views illustrating cross-sectional shapes in case that hydraulically bulged products have L-shaped cross-sections. FIGS. 12 and 13 show examples of cross-sectional shapes of pre-formed pipes on the large diameter side, wherein (a) is a cross sectional view at a position away from the large diameter side pipe end by Δl'+L0' in the axial direction, (c) is a cross sectional view of the pipe end portion, and (b) is a cross sectional view at an intermediate position therebetween.

Next, a hydraulic bulging device according to the present invention and a hydraulic bulging method using the hydraulic bulging device will be described with reference to drawings.

Figure 14A:
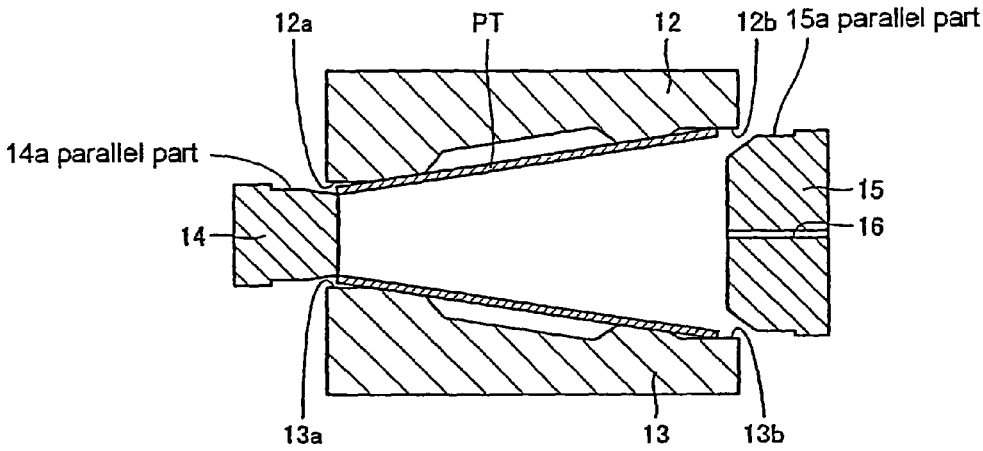
FIGS. 14A to 14C are views explaining a first example of a method of the present invention, and shows the case that a parallel part of an end portion of profile element pipe is formed prior to hydraulic bulging, where
Figure 14B:
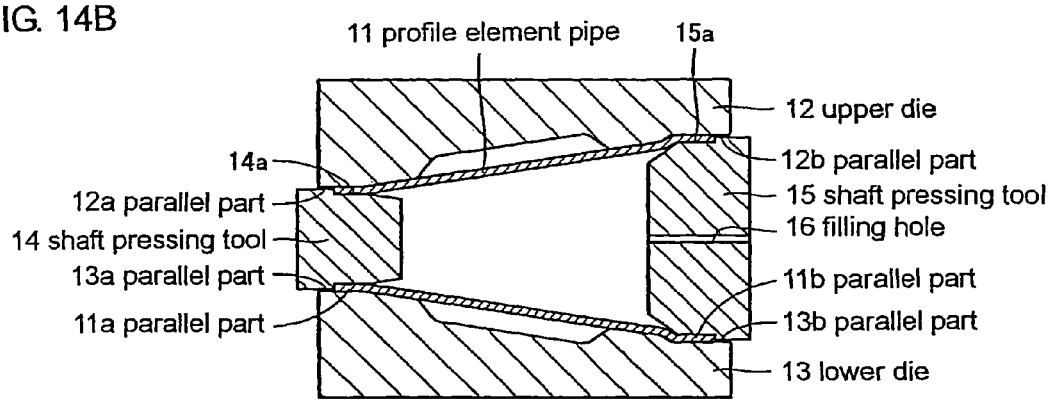
Figure 14C:
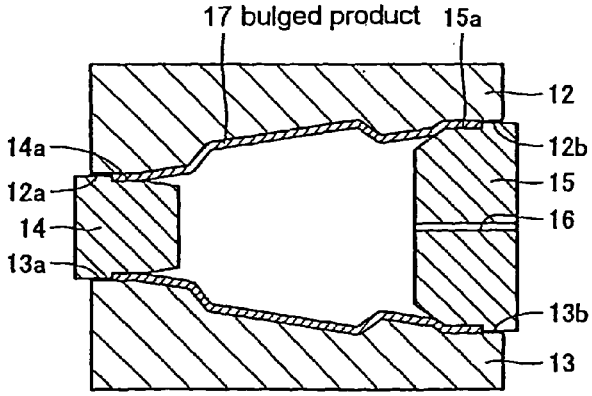

FIGS. 14A to 14C are views explaining a first example of a method of the present invention, and shows the case that a parallel part of an end portion of profile element pipe is formed prior to hydraulic bulging, where FIG. 14A is a cross-sectional view showing of a state of setting a tapered pipe on a die, FIG. 14B is a cross-sectional view showing a state where the parallel part was formed before hydraulic bulging, and FIG. 14C is a cross-sectional view showing a state where hydraulic bulging has been completed. As will be described below in more detail, the end portion of the profile element pipe is expanded by the pressing tool also serving as seal tool and reshaping tool and is reshaped in accordance with the dies surrounding the profile element pipe. In addition to the bulging step, a pressing tool (if one end of the profile element pipe is open) applies an axial force on the end part of the pipe to cause metal flow and assist in the bulging of the profile element pipe. The pressing tool engages the parallel part for sealing an interior of the profile element pipe. If the profile element pipe has parallel parts on each end, pressing tools are provided for each parallel part. Another aspect of the inventive method is the formation of the parallel part or parts by the pressing tool(s) prior to the bulging and axially pressing steps and this is also explained in more detail below.

Figure 15A:
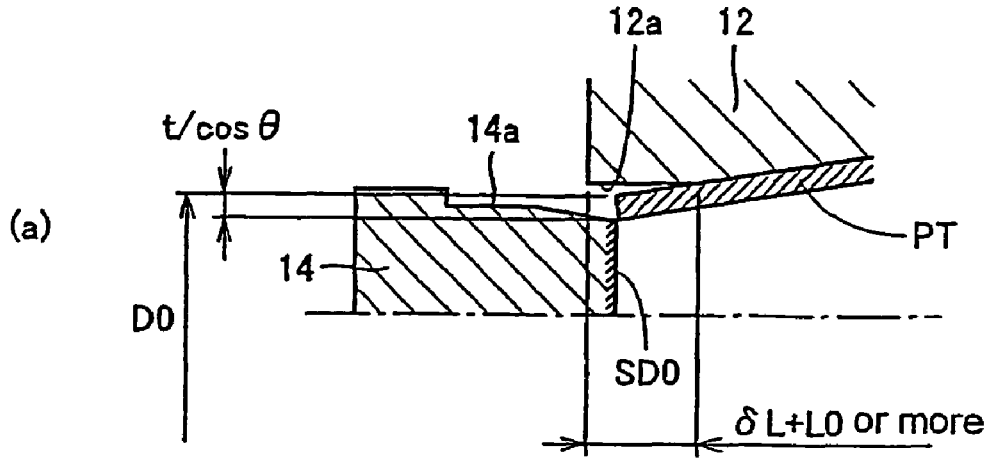
FIGS. 15A to 15C are views showing relationships among an upper die on the small diameter side, a pressing tool also serving as a sealing tool and the end portion of profile element pipe, where
Figure 15B:
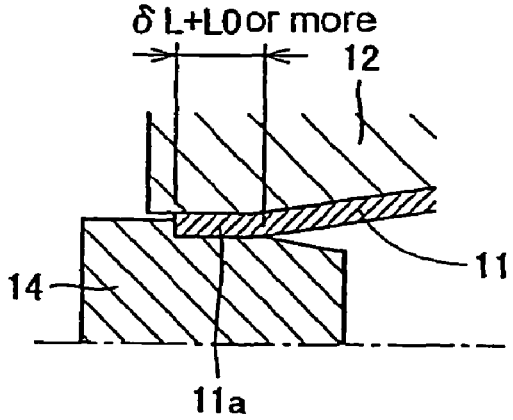
Figure 15C:
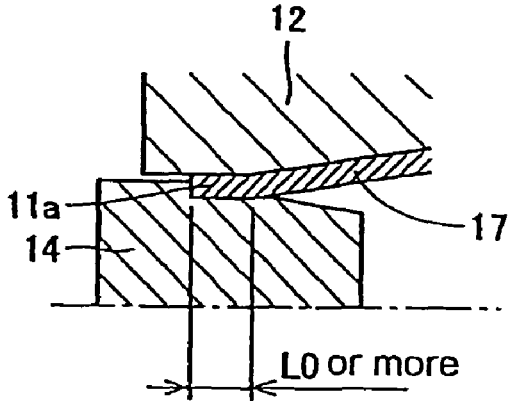

FIGS. 15A to 15C are views showing relationships among an upper die on the small diameter side, a pressing tool also serving as a sealing and reshaping tool and the end portion of the profile element pipe, where FIGS. 15A to 15C are views elaborating on FIGS. 14A to 14C.

Figure 16A:
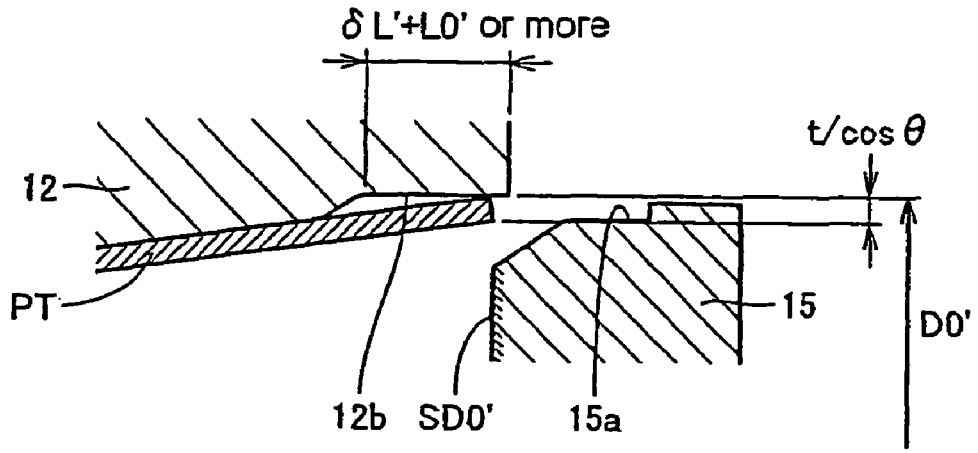
FIGS. 16A to 16C are views showing relationships among an upper die on the large diameter side, the pressing tool also serving as a sealing tool and the end portion of profile element pipe, where
Figure 16B:
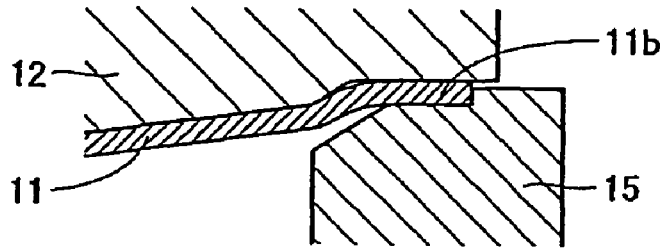
Figure 16C:
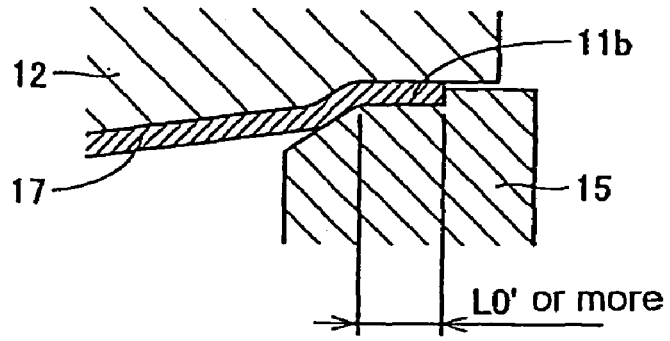

FIGS. 16A to 16C are views showing relationships among an upper die on the large diameter side, the pressing tool also serving as a sealing and reshaping tool and the end portion of the profile element pipe, where FIGS. 16A to 16C are views elaborating on FIGS. 14A to 14C.

Figure 17A:
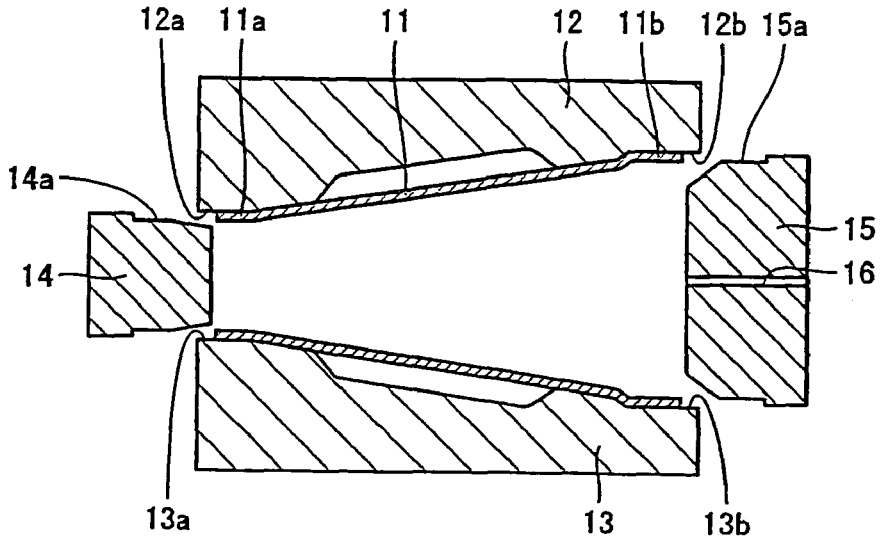
FIGS. 17A to 17C are views explaining a second example of the method of the present invention, and show a case where the parallel part of the end portion of profile element pipe is formed before setting the pipe on a die. Particularly.
Figure 17B:
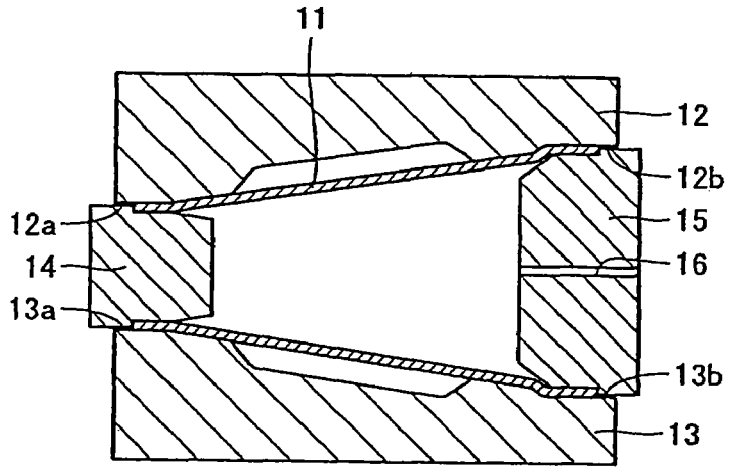
Figure 17C:
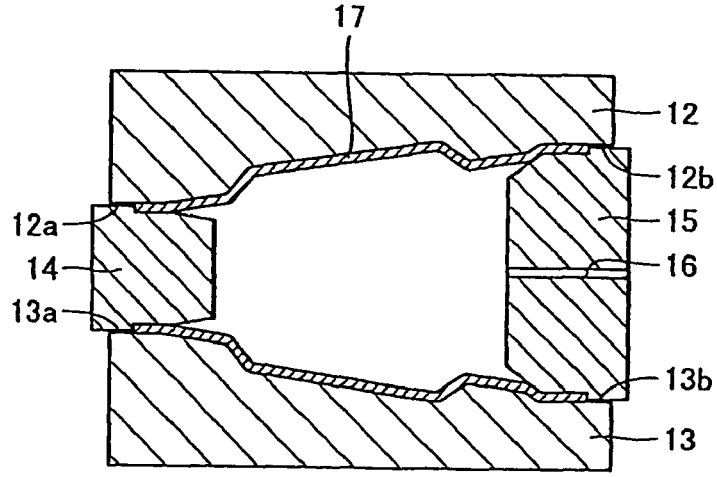

FIGS. 17A to 17C are views explaining a second example of the method of the present invention, and show the case that the parallel part of the end portion of the profile element pipe is formed before setting the pipe on a die. Particularly, FIG. 17A is a cross-sectional view showing a state of setting the profile element pipe on the die, FIG. 17B is a cross-sectional view showing a state before hydraulic bulging, and FIG. 17C is a cross-sectional view showing a state after hydraulic bulging.

Figure 18A:
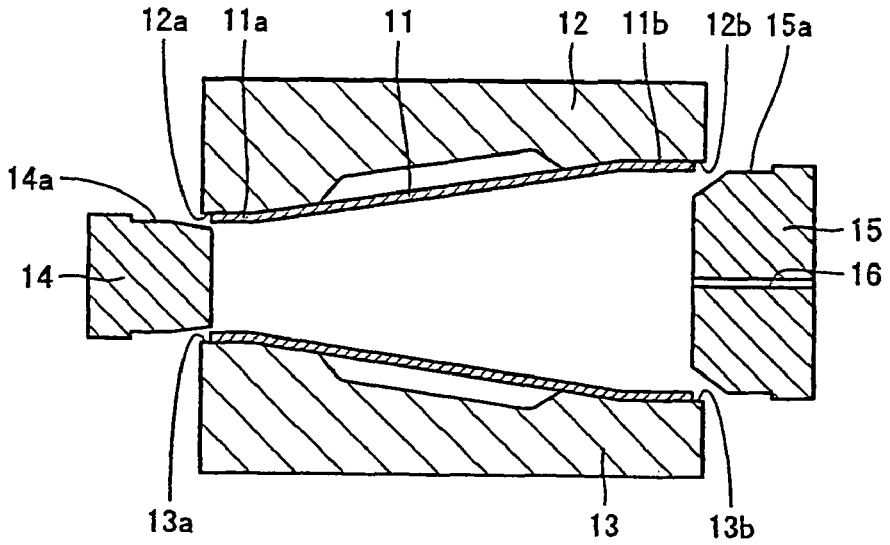
FIGS. 18A to 18C are views explaining a third example of the method of the present invention, and show another example of the case where the parallel part of the end portion of profile element pipe is formed before setting the pipe on the die.
Figure 18B:
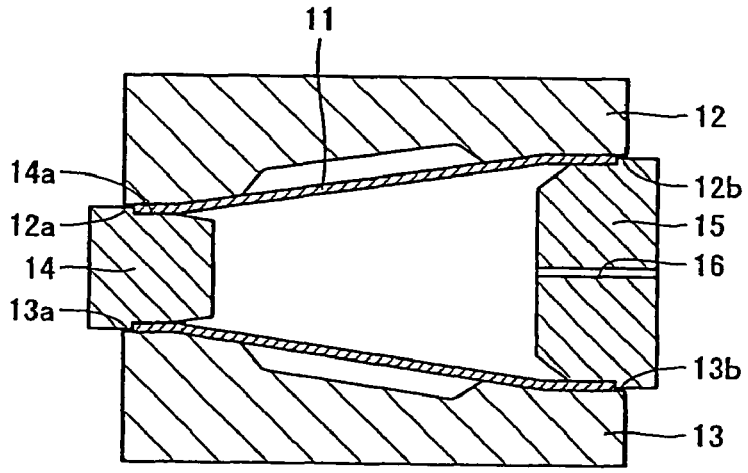
Figure 18C:
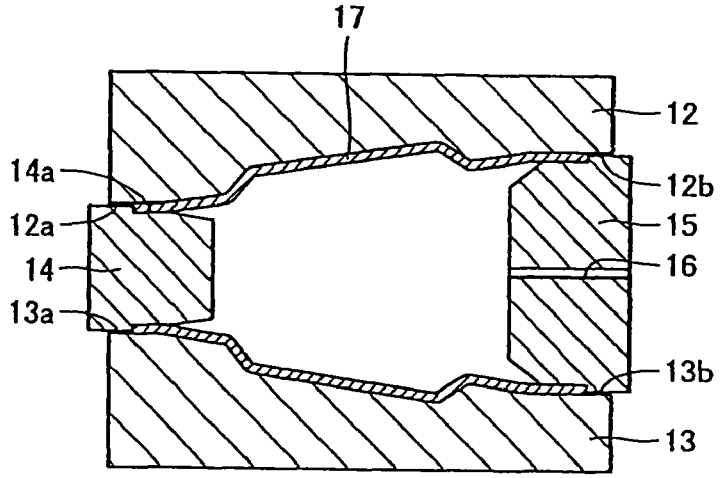

FIGS. 18A to 18C are views explaining a third example of the method of the present invention, and shows another example of the case that the parallel part of the end portion of profile element pipe is formed before setting the pipe on the die. Particularly, FIG. 18A is a cross-sectional view showing a state of setting the profile element pipe on the die, FIG. 18B is a cross-sectional view showing a state before hydraulic bulging, and FIG. 18C is a cross-sectional view showing a state after hydraulic bulging.

The hydraulic bulging device of the present invention includes an upper die 12 and a lower die 13 forming a cavity as shown in FIGS. 14, 17 and 18, for example, and pressing tools 14 and 15 which also serving as sealing tools, front end portions of which are inserted into the respective end portions of both dies 12 and 13. And the both dies 12 and 13 as well as the pressing tools 14 and 15 are constituted so that both ends of the profile element pipe 11 of the present invention are sandwiched and held by them.

Further, any one of the pressing tools is provided with a filling hole for working liquid, and an inner surface of at least one end side (both of the small diameter side and a large diameter side of the die have parallel parts in examples shown in FIGS. 14, 17 and 18) and an outer surface of the pressing tool corresponding to the inner surface of this end surface are provided with parallel parts 12*a*, 12*b*, 13*a*, 13*b*, 14*a* and 15*a*, respectively.

The parallel parts 14*a* and 15*a* of the outer surfaces of the pressing tools 14, 15 restrain the element pipe from the inner surfaces thereof during axial pressing so that smooth deformation can be made.

In this hydraulic bulging device, if the amount of axial pressing on the small diameter part side is defined as Δl, the amount of axial pressing on the large diameter part side is defined as Δl', the length required for sealing the small diameter part side is defined as L0, the length required for sealing the large diameter part side is defined as L0', lengths of the parallel parts 12*a*, 12*b*, 13*a* and 13*b* provided on an inner surface of at least one end side (both of the small diameter side and the large diameter side of the die have parallel parts in examples shown in FIGS. 14, 17 and 18) are desirably Δl+L0 or more in case of the small diameter side parallel parts, and Δl'+L0' or more in case of the large diameter side parallel parts.

Also, lengths of the parallel parts 14*a* and 15*a* of the pressing tools 14 and 15 corresponding to the parallel parts 12*a*, 12*b*, 13*a* and 13*b* provided on dies 12, 13 are desirably Δl+L0 or more in case of the small diameter side parallel parts, and L0' or more in case of the large diameter side parallel parts.

In the hydraulic bulging device of the present invention, a front end portion of the pressing tool 14 (15) also serving as a sealing tool on the small diameter side (large diameter side) must be designed to be inserted into a small diameter side end portion (large diameter side end portion) of a merely tapered pipe PT as a material for the profile element pipe 11 or a profile element pipe 11. At the same time, it is necessary that the parallel part 14*a* (15*a*) does not form a gap between a leading edge of the parallel part 14*a* (15*a*) and the inner surface of the profile element pipe 11 at the completion of axial pressing.

Therefore, for example, as shown in FIGS. 14A to 14C, after a merely tapered pipe PT as a material for the profile element pipe 11 is set on the upper die 12 and the lower die 13, if parallel parts 11*a* and 11*b* to be formed on the pipe end portions are formed in the upper die 12 and lower die 13 prior to hydraulic bulging, a pressing tool also serving as a sealing tool must satisfy the following conditions A and B.

A. Pressing Tool 14 Also Serving as a Sealing Tool on the Small Diameter Side (See FIG. 15)

A peripheral length SD0 of an envelope on the front end in which a locally concave portion was neglected satisfies the following expression (3).

$$SD0 \leqq (DO - 2t/\cos\theta)\pi \quad (3)$$

wherein D0: Outer diameter of the small diameter end portion t: Wall thickness of profile element pipe 11

$\theta = \tan^{-1}\{(D0' - D0)/(2 \cdot LT)\}$

LT: Length of tapered pipe PT

D0': Outer diameter of the large diameter end portion

B. Pressing Tool 15 Also Serving as a Sealing Tool on the Large Diameter Side (see FIGS. 16A to 16C)

A peripheral length SD0' of an envelope on the front end in which a locally concave portion was neglected satisfies the following expression (4).

$$SD0' \leqq (DO' - 2t/\cos\theta)\pi \quad (4)$$

On the other hand, as shown in FIGS. 17A to 17C, when the parallel parts 11*a* and 11*b*, which are formed on the end portions of the profile element pipe 11, are previously formed before setting on the upper die 12 and lower die 13, a pressing tool which also serving a sealing tool satisfies the following conditions C and D.

C. Pressing Tool 14 Also Serving as a Sealing Tool on the Small Diameter Side (See FIGS. 17A to 17C)

A peripheral length SD0 of a front end portion satisfies the following expression (5)

$$SD0 \leqq \text{Peripheral length SD of the parallel part } \mathbf{14}a \quad (5)$$

D. Pressing Tool 15 which Also Serving as a Sealing Tool on the Large Diameter Side (See FIGS. 17A to 17C)

A peripheral length SD0' of a front end portion satisfies the following expression (6)

$$SD0' \leqq \text{Peripheral length SD' of the parallel part } \mathbf{15}a \quad (6)$$

When a hydraulically bulged product 17 is formed by using the hydraulic bulging device according to the present invention, a merely tapered pipe PT, which is a source material for the profile element pipe 11 of the present invention, is set in a pair of dies 12 and 13 for a hydraulic bulging device as shown in FIG. 14A, for example.

Next, prior to hydraulic bulging, pressing tools 14 and 15 also serving as sealing tools are moved in the axial direction to form parallel parts 11*a* and 11*b* on an end or both ends of the tapered pipe PT sandwiched by the dies 12, 13 and the pressing tools 14, 15 as shown in FIG. 14B so that a profile element pipe 11 according to the present invention is formed.

At this time it is not necessary to synchronize the timing of axial pressing of the profile element pipe 11 by the pressing tools 14 and 15. For example, when the pressing tool 15 pushes the profile element pipe 11 to some extent pushing by the pressing tool 14 may be started. Thus, the axial pressing timing whereby the profile element pipe 11 is held stably in the dies 12 and 13 may be selected.

In this case, if the dimensional design of the pressing tools 14 and 15 also serving as sealing tools and the dies 12, 13 is made with reference to the above-mentioned dimensions, the pressing tools 14 and 15 can be smoothly inserted into the tapered pipe TP.

In a state of FIG. 14B, as shown in FIGS. 15B and 16B, parallel parts 11*a* and 11*b* having a length of L0 or more, preferably Δl+L0 or more on the small diameter side, and having a length of L0' or more on the large diameter side are formed on both ends of the tapered pipe PT so that the profile element pipe 11 of the present invention can be obtained. After that, an internal pressure is loaded on the profile element pipe 11 in a state where the sealing of working liquid is completely held.

Then, while the internal pressure of working liquid is increased, the pressing tools 14 and 15 are moved in the axial direction to be subjected to hydraulic bulging. As a result as shown in FIG. 14C, a hydraulically bulged product 17 is formed by the method of the present invention.

Namely, in hydraulic bulging in which the profile element pipe 11 of the present invention is set on the hydraulic bulging device of the present invention, the axial pressing becomes possible. As a result in the hydraulically bulged product 17 according to the method of the present invention, a larger pipe expansion ratio can be obtained than a conventional case.

Figure 4A:
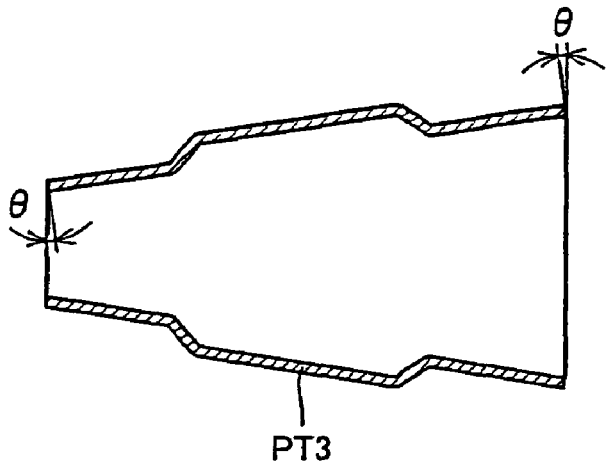
FIGS. 4A to 4C are views explaining a problem which is generated when a hydraulically bulged product having a rectangular cross-section is joined, where
Figure 4B:
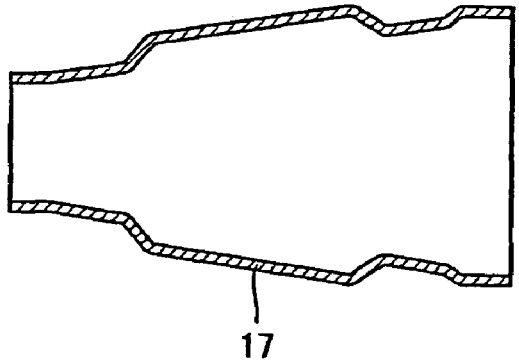
Figure 4C:
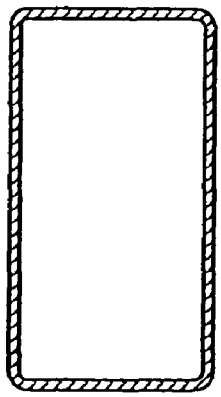

Further, since an end surface of the hydraulically bulged product 17 is vertical with respect to the longitudinal axis as shown in FIG. 4B, the joining or welding with the other part or member can be easily performed and the positioning of socket connection becomes possible.

Figure 19A:
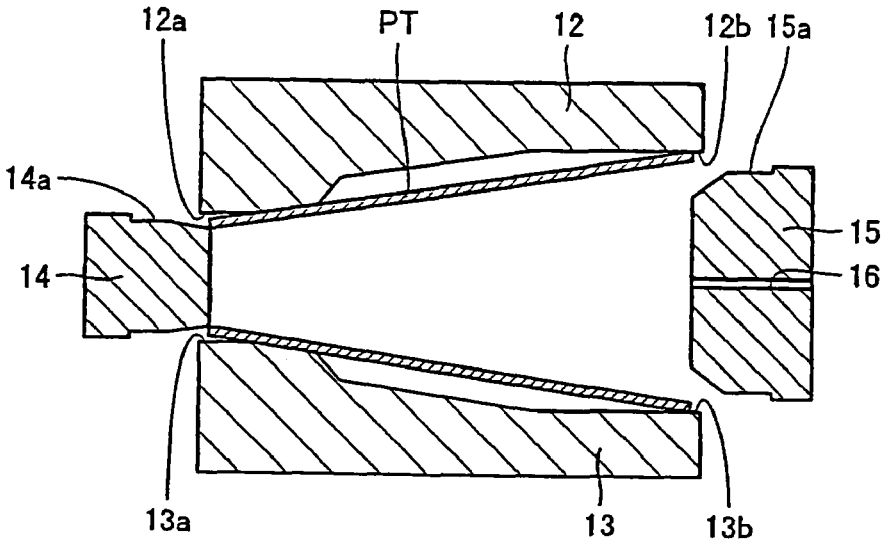
FIGS. 19A to 19C are explanatory views showing a fourth example of the method of the present invention, and show a configuration example in which an inner cavity of the parallel part at the large diameter side is axially monotonously increased with reference to the pipe-end of the large diameter side.
Figure 19B:
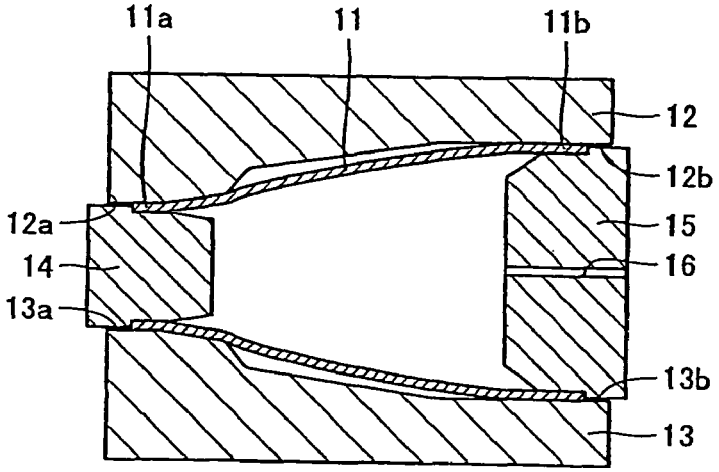
Figure 19C:
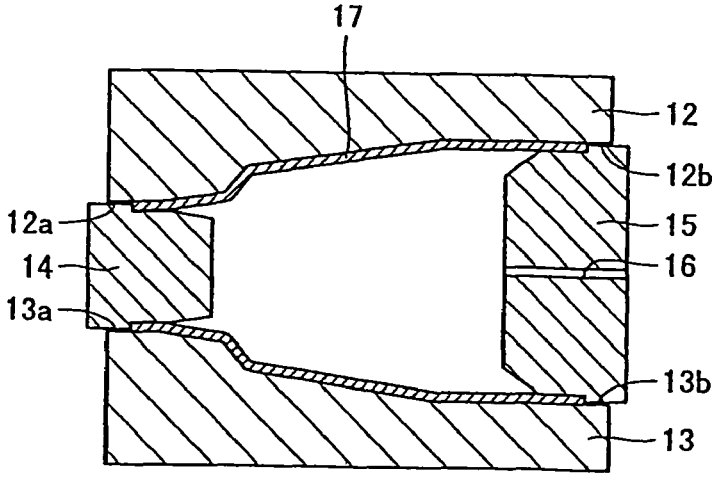

FIGS. 19A to 19C are explanatory views showing a fourth example of the method of the present invention, and shows a configuration example in which an inner cavity of the large diameter side parallel part is axially monotonously increased with reference to an end of the large diameter of the pipe. Particularly, FIG. 19A is a cross-sectional view showing a state of setting a tapered pipe on the die, FIG. 19B is a cross-sectional view showing a state where a parallel part is formed before hydraulic bulging, and FIG. 19C is a cross-sectional view of a state after hydraulic bulging.

An example shown in FIGS. 19A to 19C has a different form from examples shown in FIGS. 14, 17 and 18. That is the example shown in FIGS. 19A to 19C also has parallel parts 12*a*, 12*b*, 13*a* and 13*b* on both end portions of both dies 12 and 13. However, a cavity inside the large diameter side parallel parts 12*b* and 13*b* of dies 12 and 13 is monotonously decreased in the axial direction with reference to the large diameter end without locally narrowing a portion of the cavity as in the examples shown in FIG. 14 and the like.

Since the configuration example shown in FIG. 19A to 19C has small shaft axial pressing resistance and advantage over a metal flow, a formable range (pipe expansion limit) can be increased. Therefore, in the hydraulic bulging device of the present invention, a shape of the cavity formed in the dies 12 and 13 is preferably designed to a shape shown in FIG. 19.

On the other hand, in parts of an automobile, cross-sectional shapes of end portions of a product are similar to a rectangle, a combined rectangle, and a shape of a polygon and the like which are intricate shapes in many cases.

As described above, FIGS. 18A to 18C are views showing an example of a case that the profile element pipe 11 of the present invention shown in FIG. 9A. In working process by using it, the profile element pipe 11 shown in FIG. 9A is set in dies 12 and 13. FIG. 9B shows an enlarged view of the small diameter side profile element pipe 11 of the present invention. On the other hand, cross sectional shapes of the small diameter side parallel parts 11*a* are as shown in FIGS. 10A to 10C.

With such profile element pipes 11 having cross sectional shapes, forming is performed using the pressing tools 14 and 15 also serving as sealing tools, which is one example of the present invention. FIG. 9C shows the pressing tool 14 also serving as a small diameter side sealing tool. The parallel part 14*a* shown in FIG. 9C has a width of W0−2t, a height of H0−2t, and a radius of curvature in a corner part of R1.

The pressing tools 14 and 15 are pressed into end portions from a state shown in FIG. 18A, the forming of end portions of the profile element pipe 11 is completed at the stage of FIG. 18B, so that the profile element pipe 11 shown in FIG. 9B can be obtained while sealing of the working liquid has been fully held with the internal pressure loaded.

After that, while increasing the internal pressure of working liquid, the pressing tools 14 and 15 are moved in the axial direction so that a hydraulically bulged product 17 according to the method of the present invention can be obtained.

It is noted that the forming of the parallel parts 11*a* and 11*b* of pipe ends, which is performed prior to hydraulic bulging may be carried out at pre-forming or at a stage prior to the pre-forming. The forming can be implemented by existing working methods such as reducing, hole expanding, swaging, spinning or a combination thereof.

Figure 20A:
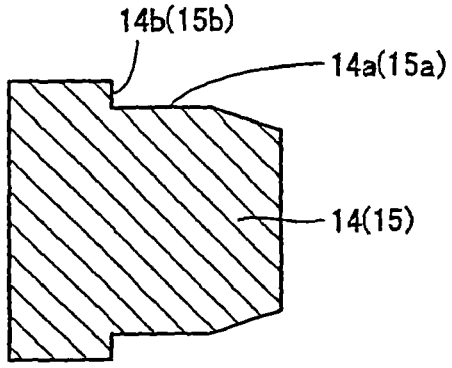
FIGS. 20A to 20D are views showing configuration examples of the pressing tool, which is a component constituting the hydraulic bulging device of the present invention, also serving as a sealing tool.
Figure 20B:
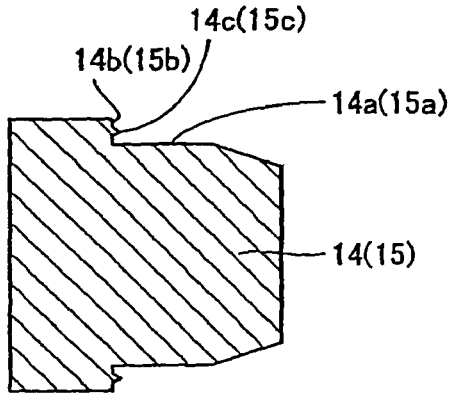
Figure 20C:
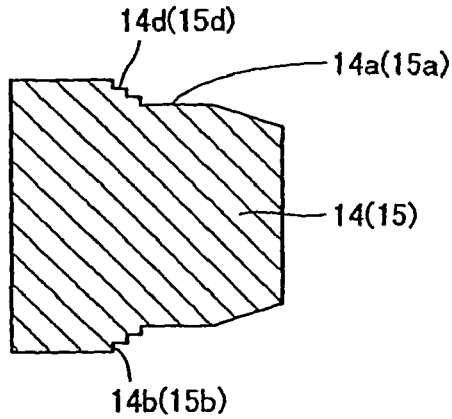
Figure 20D:
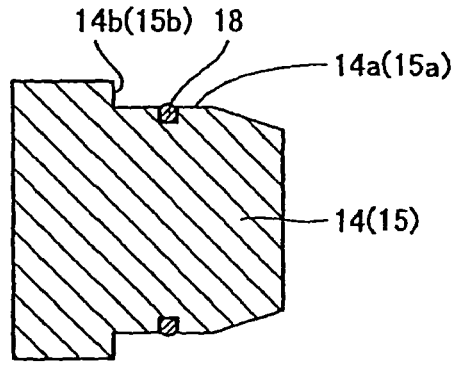

FIGS. 20A to 20D are views showing configuration examples of the pressing tool, which is a component constituting the hydraulic bulging device, also serving as a sealing and reshaping tool. FIG. 20A is a configuration example of sealing the device with an end surface 14*b* or 15*b*, which comes into contact with end surfaces of the profile element pipe 11, FIG. 20B is also a configuration example in which a protrusion 14*c* or 15*c* is provided on the end surface 14*b* or 15*b* respectively, FIG. 20C is a configuration example in which steps 14*d* and 15*d* are provided on boundary parts between the parallel part 14*a* or 15*a* and the end surface 14*b* or 15*b*, and FIG. 20D shows a configuration example in which an O ring 18 is provided on the parallel part 14*a* or 15*a*.

Any of the configuration examples shown in FIGS. 20A to 20D satisfies the relationships between the parallel parts 14*a*, 15*a* and a peripheral length of a front end shown by the expressions (3) to (6).

The above-mentioned examples show one concrete example of the present invention, and comparatively simple shapes of cavities for the dies 12 and 13 are shown. However, a three-dimensional intricate shape of the cavity, which is represented by ordinary parts of an automobile, may be used.

Figure 1A:
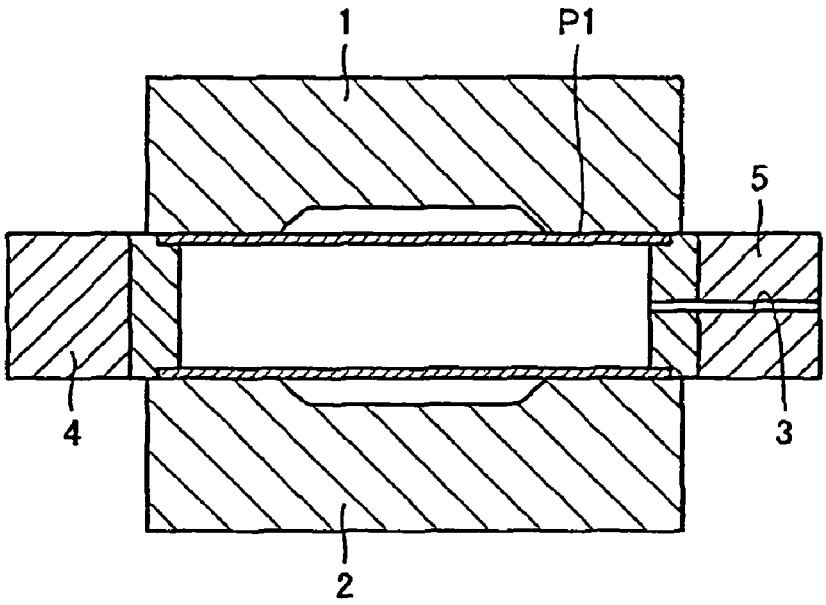
FIGS. 1A and 1B are views explaining a final process in hydraulic bulging process by which a product is obtained by using a conventional straight element pipe.
Figure 1B:
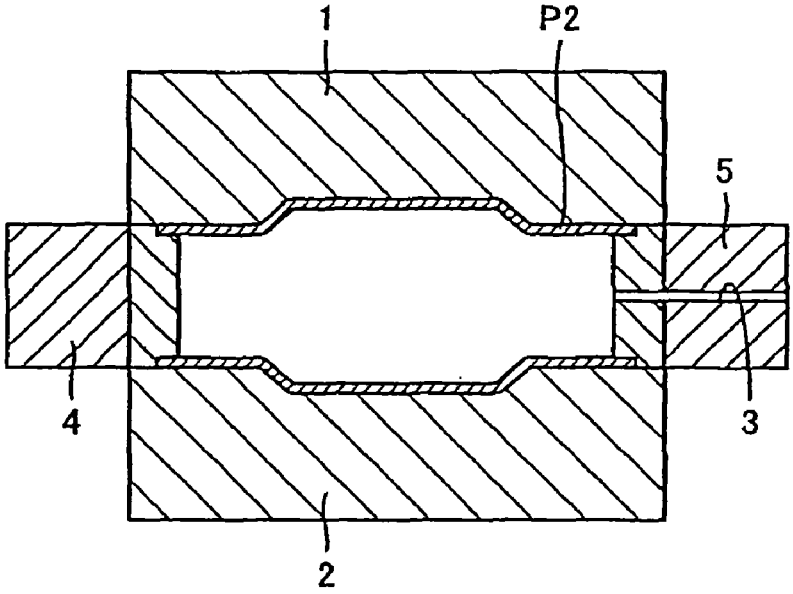
Figure 2:
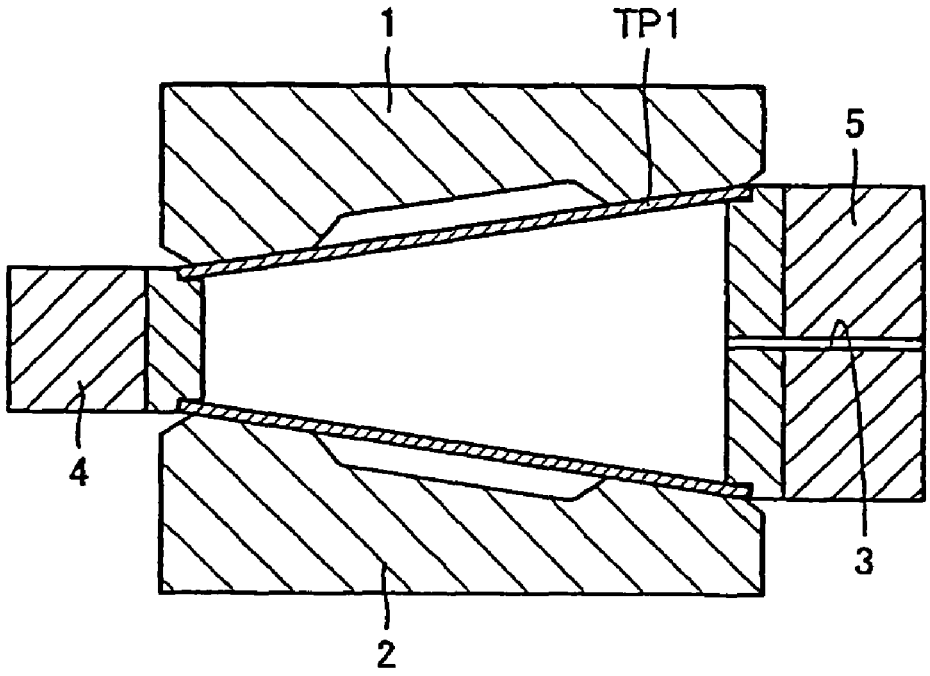
FIG. 2 is a view explaining a problem, which arises when axial pressing of a tapered element pipe is performed with a conventional pressing tool for a straight element pipe.
Figure 3A:
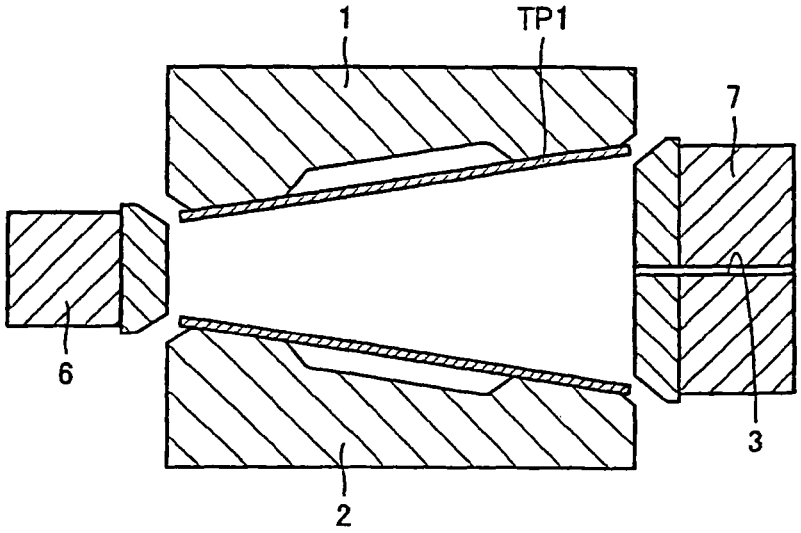
FIGS. 3A to 3C are views explaining hydraulic bulging processes using a conventional tapered element pipe, where
Figure 3B:
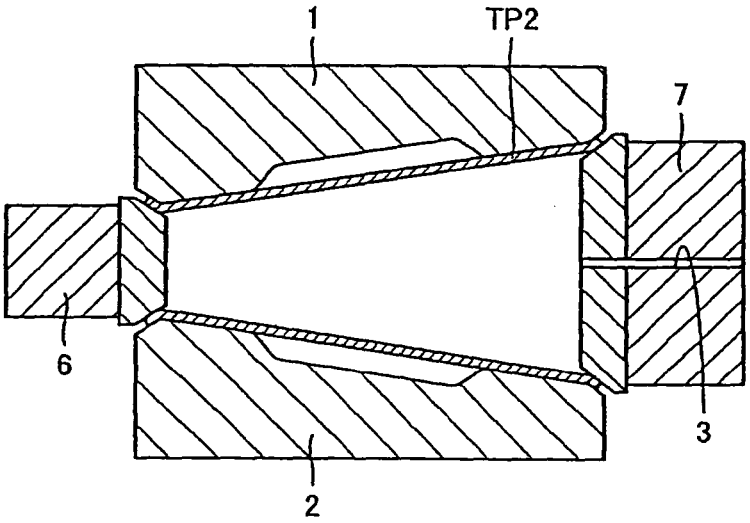
Figure 3C:
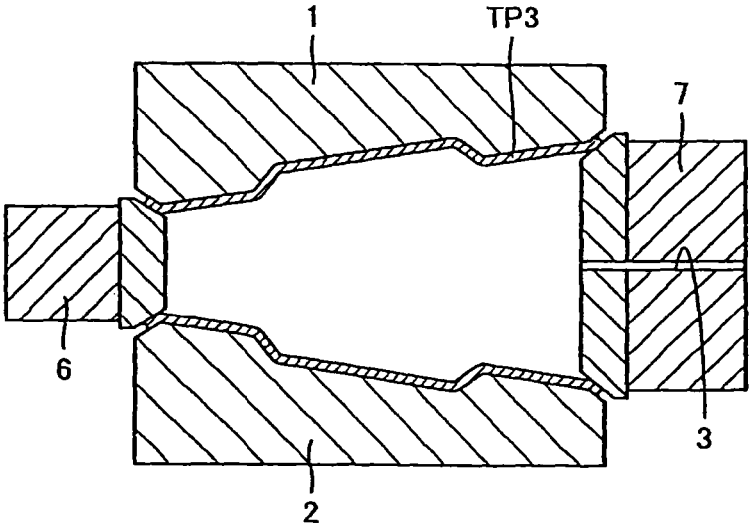

Further, in the above-mentioned examples, axial pressing applied from both a small diameter side and a large diameter side is shown. According to the present invention, the pressing tool has only to be adapted to any one side, and the other side may be adapted to, for example, a non axial pressing type as shown in FIG. 1, which is conventionally applied. Since effects of axial pressing are varied by the shapes of products, the scope of application of the present invention may be determined case by case.

Further, in the above-mentioned examples, although, as a material for the profile element pipe 11, the case using a merely tapered pipe was described, a welded pipe by combining merely tapered pipes and a pipe in combination of a tapered pipe with a general straight pipe can also be applied as source materials of the profile element pipes 11 of the present invention because each end portion of the pipe can be closely approximated to the relevant part of a merely tapered pipe.

INDUSTRIAL APPLICABILITY

In a hydraulic bulging method using the profile element pipe having a peripheral length with an outer diameter gradually increasing or decreasing from one axial side to the other thereof according to the present invention, at least one end part of the profile element pipe to form parallel part being parallel to a longitudinal axis of the profile element pipe is reshaped, subsequently the profile element pipe is, hydraulically bulged by pressurizing an interior of the profile element pipe and reshaping of the profile element pipe and applying an axial force to the end of the parallel part using a tool adapted to engage the parallel part for metal flow and reshaping to form a bulged pipe with the parallel part sealing an interior of the profile element pipe. In another hydraulic bulging method, a profile element pipe, having a parallel part formed on at least one end of the profile element pipe, is provided and then the profile element pipe is hydraulically bulged by pressurizing an interior of the profile element pipe and reshaping of the profile element pipe and applying an axial force to the end of the parallel part using a tool adapted to engage the parallel part for metal flow and reshaping to form a bulged pipe. In a hydraulic bulging device, pressing tools serves as seal tools and reshaping tools for holding a profile element pipe having a peripheral length with an outer diameter gradually increasing or decreasing from one axial side to the other thereof, while sandwiching the profile element pipe with said dies, wherein a filling hole for working liquid is provided at any one of said pressing tools and parallel parts are provided on at least one end-portion inner surface of said dies and an outer surface of said pressing tool corresponding to this end-portion inner surface, respectively. Thus, in the hydraulically bulged product, a larger pipe expansion ratio than a conventional case can be obtained and a joining and socket connection thereof to the other part can also be easily performed and also can be applied for use of automobiles and further other industrial machinery widely.

What is claimed is:

1. A method of hydraulic bulging a profile element pipe comprising:

providing a profile element pipe having a peripheral length with an outer diameter gradually increasing or decreasing from one axial side toward the other thereof;

reshaping at least one end part of the profile element pipe to form parallel part being parallel to a longitudinal axis of the profile element pipe; and hydraulically bulging the profile element pipe by pressurizing an interior of the profile element pipe and reshaping of the profile element pipe and applying an axial force to the end of the parallel part using a tool adapted to engage the parallel part for metal flow and reshaping to form a bulged pipe, the engagement of the tool with the parallel part sealing an interior of the profile element pipe, and wherein the tool engages the parallel part for a first length for sealing, and the tool moves a second length during application of the axial force, the parallel part of the profile element pipe having a length greater than the sum of the first and second lengths.

2. The method of claim 1, wherein the parallel part is reshaped by the tool prior to the hydraulic bulging and axial force applying steps.

3. The method of claim 1, wherein the end part of the profile pipe element is provided with a rectangular cross section or a polygonal cross section, which forms corners between adjacent sides of the end part, each corner having a radius R of curvature, and wherein the radius of curvature for each corner increases or decreases along a longitudinal length of the end part.

4. The method of claim 1, wherein the hydraulic bulging step is performed using a pair of dies, each die having respective end parts, at least one end part having a die parallel part to reshape the end part on the profile element pipe; and wherein the tool is inserted into the at least one end part of each die for holding said profile element pipe with the profile element being sandwiched with said dies, and supplying a working liquid through a filling hole in the tool for pressurizing the interior of the profile element pipe.

5. The method of claim 1, wherein each end of the profile element pipe has the parallel part and a tool is provided for each parallel part, each parallel part being engaged by its respective tool for sealing and receiving the axial force.

6. The method of claim 5, wherein each parallel part is reshaped by each respective tool prior to the hydraulic bulging and axial force applying steps.

7. The method of claim 5, wherein each parallel part of the profile pipe element is provided with a rectangular cross section or a polygonal cross section, which forms corners between adjacent sides of the parallel part, each corner having a radius R of curvature, and wherein the radius of curvature for each corner increases or decreases along a longitudinal length of the parallel part.

8. The method of claim 5, wherein the hydraulic bulging step is performed using a pair of dies, each die having respective end parts, each end part having a die parallel part that is aligned with a respective parallel part on the profile element pipe; and wherein each tool is inserted into each end part of each die for holding said profile element pipe with the profile element being sandwiched with said dies, and supplying a working liquid through a filling hole in at least one of the tools for pressurizing the interior of the profile element pipe.

9. A method of hydraulic bulging a profile element pipe comprising:

providing a profile element pipe having a peripheral length with an outer diameter gradually increasing or decreasing from one axial side toward the other thereof;

reshaping at least one end part of the profile element pipe to form parallel part being parallel to a longitudinal axis of the profile element pipe; and hydraulically bulging the profile element pipe by pressurizing an interior of the profile element pipe and reshaping of the profile element pipe and applying an axial force to the end of the parallel part using a tool adapted to engage the parallel part for metal flow and reshaping to form a bulged pipe, the engagement of the tool with the parallel part sealing an interior of the profile element pipe, wherein each end of the profile element pipe has the parallel part and a tool is provided for each parallel part, each parallel part being engaged by its respective tool for sealing and receiving the axial force, and further wherein each tool engages its respective parallel part for a first length for sealing, and each tool moves a second length during application of the axial force, each parallel part of the profile element pipe having a length greater than the sum of the first and second lengths.

10. A method of hydraulic bulging a profile element pipe comprising:

providing a profile element pipe having a peripheral length with an outer diameter gradually increasing or decreasing from one axial side toward the other thereof and having a parallel part formed on at least one end of the profile element pipe, the parallel part being parallel to a longitudinal axis of the profile element pipe; and hydraulically bulging the profile element pipe by pressurizing an interior of the profile element pipe and reshaping of the profile element pipe and applying an axial force to the end of the parallel part using a tool adapted to engage the parallel part for metal flow and reshaping to form a bulged pipe, the engagement of the tool with the parallel part sealing an interior of the profile element pipe, wherein the tool engages the parallel part for a first length for sealing, and the tool moves a second length during application of the axial force, the parallel part of the profile element pipe having a length greater than the sum of the first and second lengths.

11. The method of claim 10, wherein the parallel part is formed by the tool prior to the hydraulic bulging and axial force applying steps.

12. The method of claim 10, wherein the parallel part of the profile pipe element is provided with a rectangular cross section or a polygonal cross section, which forms corners between adjacent sides of the parallel part, each corner having a radius R of curvature, and wherein the radius of curvature for each corner increases or decreases along a longitudinal length of the parallel part.

13. The method of claim 10, wherein the hydraulic bulging step is performed using a pair of dies, each die having respective end parts, at least one end part having a die parallel part that is aligned with the parallel part on the profile element pipe; and wherein the tool is inserted into the at least one end part of each die for holding said profile element pipe with the profile element being sandwiched with said dies, and supplying a working liquid through a filling hole in the tool for pressurizing the interior of the profile element pipe.

14. The method of claim 10, wherein each end of the profile element pipe has the parallel part and a tool is provided for each parallel part, each parallel part being engaged by its respective tool for sealing and receiving the axial force.

15. The method of claim 14, wherein each parallel part is formed by each respective tool prior to the hydraulic bulging and axial force applying steps.

16. The method of claim 14, wherein each parallel part of the profile pipe element is provided with a rectangular cross section or a polygonal cross section, which forms corners between adjacent sides of the parallel part, each corner having a radius R of curvature, and wherein the radius of curvature for each corner increases or decreases along a longitudinal length of the parallel part.

17. The method of claim 14, wherein the hydraulic bulging step is performed using a pair of dies, each die having respective end parts, each end part having a die parallel part that is aligned with a respective parallel part on the profile element pipe; and wherein each tool is inserted into each end part of each die for holding said profile element pipe with the profile element being sandwiched with said dies, and supplying a working liquid through a filling hole in at least one of the tools for pressurizing the interior of the profile element pipe.

18. A method of hydraulic bulging a profile element pipe comprising:

providing a profile element pipe having a peripheral length with an outer diameter gradually increasing or decreasing from one axial side toward the other thereof and having a parallel part formed on at least one end of the profile element pipe, the parallel part being parallel to a longitudinal axis of the profile element pipe; and hydraulically bulging the profile element pipe by pressurizing an interior of the profile element pipe and reshaping of the profile element pipe and applying an axial force to the end of the parallel part using a tool adapted to engage the parallel part for metal flow and reshaping to form a bulged pipe, the engagement of the tool with the parallel part sealing an interior of the profile element pipe, wherein each end of the profile element pipe has the parallel part and a tool is provided for each parallel part, each parallel part being engaged by its respective tool for sealing and receiving the axial force, and further wherein each tool engages its respective parallel part for a first length for sealing, and each tool moves a second length during application of the axial force, each parallel part of the profile element pipe having a length greater than the sum of the first and second lengths.

19. A hydraulic bulging device characterized by comprising:

a pair of dies, and pressing tools also serving as seal tools and reshaping tools, in which front end portions of the tools are inserted into both ends of said dies, for holding said profile element pipe having a peripheral length with an outer diameter gradually increasing or decreasing from one axial side to the other thereof, while sandwiching the profile element pipe with said dies, wherein a filling hole for working liquid is provided at any one of said pressing tools and parallel parts are provided on at least one end-portion inner surface of said dies and an outer surface of said pressing tool corresponding to this end-portion inner surface, respectively, and wherein when an amount of axial pressing on the small diameter side is defined as $\delta L$, an amount of axial pressing on the large diameter side of is defined as $\delta L'$, a length necessary for sealing on the small diameter side is defined as $L0$, and a length necessary for sealing on the large diameter side is defined as $L0'$, a length of a parallel part provided on the small diameter side of said die is $\delta L+L0$ or more, a length of a parallel part provided on the large diameter side of said die is $\delta L'+L0'$ or more, and a length of a parallel part provided on the small diameter side of the pressing tool is $\delta L+L0$ or more, and a length of a parallel part provided on the large diameter side of the shaft pressing tool is $L0'$ or more.

* * * * *